US008563208B2

(12) United States Patent
Nakazawa et al.

(10) Patent No.: US 8,563,208 B2
(45) Date of Patent: Oct. 22, 2013

(54) ELECTROSTATIC CHARGE IMAGE DEVELOPING TONER AND METHOD OF PRODUCING THE SAME, ELECTROSTATIC CHARGE IMAGE DEVELOPER, TONER CARTRIDGE, PROCESS CARTRIDGE, AND IMAGE FORMING DEVICE

(75) Inventors: Hiroshi Nakazawa, Kanagawa (JP); Masanobu Ninomiya, Kanagawa (JP); Hirokazu Hamano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/540,463

(22) Filed: Jul. 2, 2012

(65) Prior Publication Data

US 2012/0281997 A1 Nov. 8, 2012

Related U.S. Application Data

(62) Division of application No. 12/428,068, filed on Apr. 22, 2009, now Pat. No. 8,329,375.

(30) Foreign Application Priority Data

Nov. 18, 2008 (JP) ..... 2008-294546

(51) Int. Cl.
*G03G 9/08* (2006.01)

(52) U.S. Cl.
USPC ..... 430/109.4; 430/110.3; 430/111.4

(58) Field of Classification Search
USPC ..... 430/109.4, 110.3, 111.4; 399/222
See application file for complete search history.

(56) References Cited

U.S. PATENT DOCUMENTS

| | | | | |
|---|---|---|---|---|
| 6,171,744 | B1 | 1/2001 | Nakazawa et al. | |
| 6,432,590 | B1 | 8/2002 | Ueda et al. | |
| 6,541,173 | B1 | 4/2003 | Kido et al. | |
| 7,288,348 | B2 | 10/2007 | Hayami et al. | |
| 7,320,850 | B2 | 1/2008 | Itakura et al. | |
| 2001/0026899 | A1 | 10/2001 | Uchida et al. | |
| 2001/0046636 | A1 | 11/2001 | Daimon et al. | |
| 2003/0129518 | A1 | 7/2003 | Sawada et al. | |
| 2005/0095523 | A1 | 5/2005 | Shimokusa et al. | |
| 2006/0121378 | A1 | 6/2006 | Chung et al. | |
| 2008/0107991 | A1 | 5/2008 | Hamano | |
| 2009/0017392 | A1* | 1/2009 | Higuchi et al. | 430/108.8 |
| 2010/0304286 | A1 | 12/2010 | Aoki et al. | |

FOREIGN PATENT DOCUMENTS

| | | | |
|---|---|---|---|
| CN | 101174112 | A | 5/2008 |
| EP | 1 580 614 | A2 | 9/2005 |
| EP | 1 591 839 | A1 | 11/2005 |
| JP | A-02-097969 | | 4/1990 |
| JP | A-07-028277 | | 1/1995 |
| JP | A-08-123076 | | 5/1996 |
| JP | A-09-034174 | | 2/1997 |
| JP | A-09-197718 | | 7/1997 |
| JP | A-09-197882 | | 7/1997 |
| JP | A-09-319158 | | 12/1997 |
| JP | A-2000-275899 | | 10/2000 |
| JP | A-2001-305796 | | 11/2001 |
| JP | A-2001-318484 | | 11/2001 |
| JP | A-2002-006546 | | 1/2002 |
| JP | A-2002-287421 | | 10/2002 |
| JP | A-2003-167384 | | 6/2003 |
| JP | A-2003-270852 | | 9/2003 |
| JP | A-2004-279476 | | 10/2004 |
| JP | A-2005-049492 | | 2/2005 |
| JP | A-2005-266753 | | 9/2005 |
| JP | A-2005-301261 | | 10/2005 |
| JP | A-2006-072034 | | 3/2006 |
| JP | A-2006-276074 | | 10/2006 |
| JP | A-2007-271820 | | 10/2007 |
| JP | A-2007-286144 | | 11/2007 |
| JP | A-2007-328043 | | 12/2007 |

OTHER PUBLICATIONS

Aoki, T. "Chemical Toner Technology and The Future", IS&T's NIP19, Springfield, VA (2003) pp. 2-4.*
Office Action issued in Japanese Patent Application No. 2008-294546, on Aug. 31, 2010 (with translation).
European Search Report issued in European Patent Application No. 09163235.6 dated Nov. 15, 2010.
Mar. 6, 2012 Office Action issued in Chinese Patent Application No. 200910140818.2 (with English-language translation).
U.S. Appl. No. 12/428,068 to Hiroshi Nakazawa et al., filed Apr. 22, 2009.

* cited by examiner

*Primary Examiner* — Christopher Rodee
(74) *Attorney, Agent, or Firm* — Oliff & Berridge, PLC

(57) ABSTRACT

A toner for developing an electrostatic charge image includes: an amorphous polyester resin; a crystalline polyester resin; and a releasing agent, an amount of the releasing agent in the toner being from 5 to 15% by weight; an amount of the releasing agent present at a surface of the toner being from 10 to 35% by weight; and the toner showing at least one endothermic peak in each of a temperature range from 45 to 60° C., a temperature range from 65 to 80° C., and a temperature range from 85 to 100° C. in a temperature-rise process of differential scanning calorimetry of the toner.

8 Claims, 3 Drawing Sheets

ELECTROSTATIC CHARGE IMAGE DEVELOPING TONER AND METHOD OF PRODUCING THE SAME, ELECTROSTATIC CHARGE IMAGE DEVELOPER, TONER CARTRIDGE, PROCESS CARTRIDGE, AND IMAGE FORMING DEVICE

CROSS-REFERENCE TO RELATED APPLICATION

This is a Division of application Ser. No. 12/428,068 filed Apr. 22, 2009, which claims priority to Japanese Patent Application No. 2008-294546, filed on Nov. 18, 2008. The prior applications, including the specifications, drawings and abstract are incorporated herein by reference in their entirety.

BACKGROUND

1. Technical Field

The present invention relates to a toner for developing an electrostatic charge image and a method of producing the same, a developer for electrostatic charge image development, a toner cartridge, a process cartridge, and an image forming device.

2. Related Art

Methods by means of which an electrostatic latent image is formed, the electrostatic latent image is developed, and image information is thereby visualized, such as an electrophotographic method, are currently in use in various fields. In such methods, an image is formed in such a manner that an entire surface of a photoreceptor is charged, the photoreceptor surface is exposed to laser light in accordance with image information to form an electrostatic latent image thereon, the electrostatic latent image is developed with a developer containing toner to form a toner image, and finally the toner image is transferred and fixed on a surface of a recording medium.

Recently, with the further development of the pronounced information orientation of society, images obtained by various methods are required to provide as more high-quality images. Accordingly, in various image formation methods, research regarding higher quality images is underway. In an electrophotographic method, in particular, high function toner having a smaller particle diameter and a narrower particle size distribution is sought in order to realize higher definition images.

Furthermore, in recent years, with respect to the electrophotographic method as well as to other methods, demands for energy saving are ever increasing. Accordingly, in copy machines and printers, for example, in order to reduce the amount of energy used, a technology for fixing toner at lower energy and toner that can be fixed at a lower temperature is in high demand.

As a method of lowering a fixing temperature of toner, for instance, a technology is known in which the glass transition temperature of a resin (binder resin) included in the toner is lowered.

Further, in addition to improved toner fixability, it is also required that blocking of toner powder, and image defects such as white stripes, trickle-down, and toner spillage stripes that are caused by the blocking, are suppressed. Accordingly, a binder resin having a glass transition temperature of 50° C. or more is used in existing toners.

SUMMARY

According to an aspect of the invention, there is provided a toner for developing an electrostatic charge image, including:

an amorphous polyester resin;

a crystalline polyester resin; and a releasing agent, an amount of the releasing agent in the toner being from about 5 to about 15% by weight;

an amount of the releasing agent present at a surface of the toner being from about 10 to about 35% by weight; and the toner showing at least one endothermic peak in each of a temperature range from about 45 to about 60° C., a temperature range from about 65 to about 80° C., and a temperature range from about 85 to about 100° C. in a temperature-rise process of differential scanning calorimetry of the toner.

BRIEF DESCRIPTION OF THE DRAWINGS

Exemplary embodiments of the present invention will be described in detail based on the following figures, wherein.

DETAILED DESCRIPTION

Figure 1:
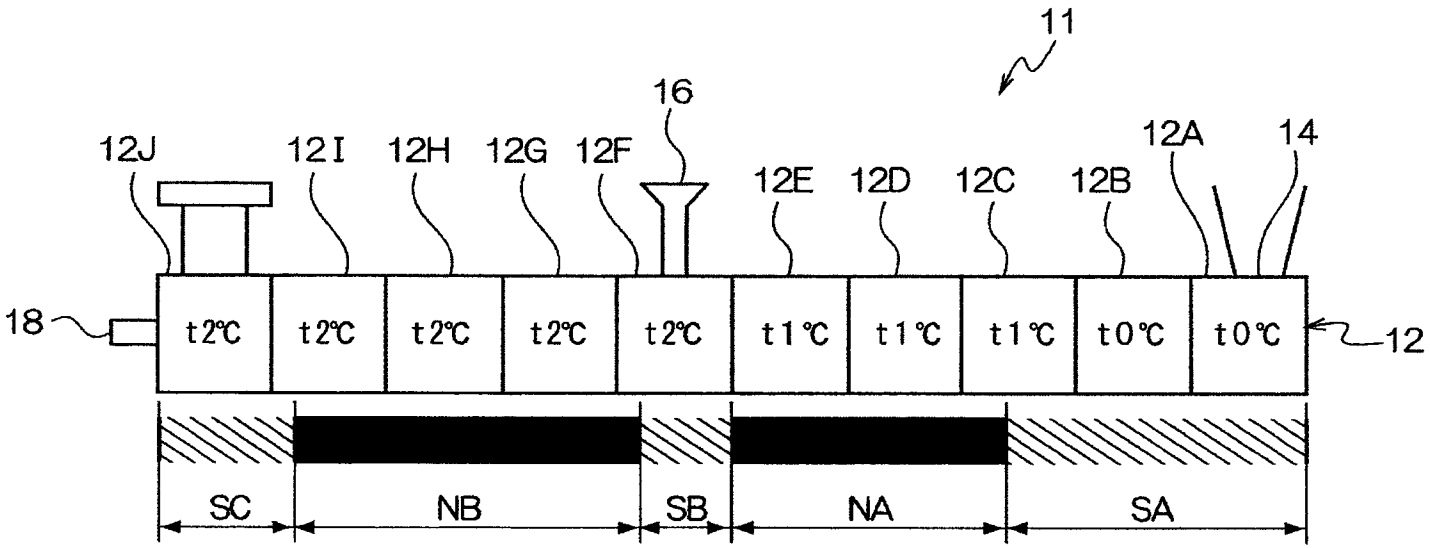
FIG. 1 is a diagram showing a state of a screw of an example of a screw extruder that is used for producing an electrostatic charge image developing toner of the present invention.

In what follows, the present invention will be described in detail.

Electrostatic Charge Image Developing Toner

An electrostatic charge image developing toner (hereinafter, in some cases, simply referred to as "toner") according to an exemplary embodiment of the invention includes a binder resin containing an amorphous polyester resin and a crystalline polyester resin and a releasing agent, and may further include other components as required.

The amount of the releasing agent in the toner is from 5 to 15% by weight or from about 5 to about 15% by weight, and the amount (existence ratio) of the releasing agent present at the surface of the toner is from 10 to 35% by weight or from about 10 to about 35% by weight.

Furthermore, the toner of the exemplary embodiment shows at least three endothermic peaks when a temperature is elevated in (i.e. in a heating process of) differential scanning calorimetry. The three endothermic peaks specifically include an endothermic peak obtained in the range from 45 to 60° C. or from about 45 to about 60° C. (hereinafter, in some cases, referred to as "first endothermic peak"), an endothermic peak obtained in the range from 65 to 80° C. or from about 65 to about 80° C. (hereinafter, in some cases, referred to as "second endothermic peak"), and an endothermic peak obtained in the range from 85 to 100° C. or from about 85 to about 100° C. (hereinafter, in some cases, referred to as "third endothermic peak").

Temperatures at which endothermic peaks are obtained in the heating process of the differential scanning calorimetry of a toner are determined depending on the kinds of an amorphous polyester resin, a crystalline polyester resin and a releasing agent that are included in the toner and compatibility thereof. The toner of the exemplary embodiment has the first endothermic peak derived from the compatibility of the amorphous polyester resin and the crystalline polyester resin, the second endothermic peak derived from the crystalline polyester resin, and the third endothermic peak derived from the releasing agent. That is, in the toner of the exemplary embodiment, the compatibility between the releasing agent and the crystalline polyester resin is considered to be excellent, and the compatibility between the crystalline polyester resin and the amorphous polyester resin is also considered to be excellent.

In general, when a toner containing a releasing agent is prepared by a kneading and pulverizing method, interfaces between a binder resin and a releasing agent are particularly likely to be pulverized in a pulverizing process; accordingly, a toner tends to be formed that has a significant amount of releasing agent exposed at the toner surface. In a toner having a significant amount of releasing agent exposed at the surface thereof, in some cases, the powder flowability may be deteriorated, soft blocking (black stripes/trickling contamination) may be caused and toner feeding property may be deteriorated, causing difficulties in controlling image density.

On the other hand, when the compatibility between the releasing agent and the crystalline polyester resin and the compatibility between the crystalline polyester resin and the amorphous polyester resin are excellent, a releasing agent that is compatible with the crystalline resin is dispersed in the amorphous resin; accordingly, in a pulverization process when the toner is produced, the pulverization at interfaces between the binder resin and releasing agent does not occur as easily. As a result, it is thought that even when the amount of the releasing agent in the toner is increased to improve the offset resistance, the releasing agent is prevented from being exposed at the toner surface, whereby the amount of the releasing agent present at the toner surface may be kept low to balance the offset resistance and powder flowability.

Also when a crystalline resin is used, as a binder resin, together with an amorphous resin, in particular when a ratio of the crystalline resin is lower than a ratio of the amorphous resin and a continuous phase of the amorphous resin is formed, pulverization may occur particularly in interfaces between the crystalline resin and the amorphous resin during a production process of a toner. In such a toner, a significant amount of the crystalline resin may sometimes be exposed at the surface of the toner, whereby the charge stability may be deteriorated and fogging and toner scattering may occur.

Furthermore, it is considered that when a volume average particle diameter of toner is made smaller to form high-quality (high definition) images, a specific surface area thereof becomes larger than that when a particle diameter is large; accordingly, the releasing agent and the crystalline resin that are exposed at the toner surface largely affect the powder flowability and charging stability.

Endothermic Peaks

In what follows, endothermic peaks obtained in a heating process of differential scanning calorimetry of a toner will be described.

A first endothermic peak is obtained in the range from 45 to 60° C. as mentioned above and derived from the compatibility between the amorphous polyester resin and the crystalline polyester resin. The temperature of the first endothermic peak is preferably from 48 to 55° C. When the first endothermic peak is obtained in the temperature range, the low temperature fixability (improvement in fixing strength at low temperatures, high glossiness at a low temperature fixing (for example, at 110° C.)) may be obtained, and cracks in the interfaces between the crystalline polyester resin and the amorphous polyester resin may hardly be generated during a pulverization process, whereby the crystalline resin may be inhibited from being exposed at the toner surface.

When a temperature at which the endothermic peak derived from the compatibility between the amorphous polyester resin and the crystalline polyester resin is generated is lower than the above temperature range, the amorphous polyester resin and the crystalline polyester resin are compatibilized, whereby the glass transition temperature of a binder resin may be lowered, and the powder flowability and thermal characteristics may be deteriorated. Meanwhile, when a temperature at which the endothermic peak derived from the compatibility between the amorphous polyester resin and the crystalline polyester resin is generated is higher than the above temperature range, sufficient low temperature fixability may not be obtained even when the amount of the crystalline polyester resin is increased.

A second endothermic peak is obtained in the range from 65 to 80° C. as mentioned above and derived from the crystalline polyester resin. The temperature of the second endothermic peak is preferably from 70 to 80° C. When the second endothermic peak is obtained in the temperature range, the low temperature fixability may be obtained.

When a temperature at which the endothermic peak derived from the crystalline polyester resin is generated is lower than the above temperature range, the crystalline resin may be exposed at the toner surface to deteriorate the powder characteristics. When a temperature at which the endothermic peak derived from the crystalline polyester resin is generated is higher than the above temperature range, the compatibility of the crystalline polyester resin and the amorphous polyester resin may be deteriorated, whereby the low temperature fixability may not be obtained.

A third endothermic peak is obtained in the range from 85 to 100° C. as mentioned above and derived from the releasing agent. The temperature of the third endothermic peak is preferably from 85 to 95° C. When the third endothermic peak is obtained in the temperature range, the releasability between a recording medium and a fixing device or the like during low temperature fixing (for example, at 110° C.) may be obtained, and a wide fixable temperature range (a fixing temperature range in which toner offset is not generated during fixing) may be obtained.

When a temperature at which the endothermic peak derived from the releasing agent is generated is lower than the above temperature range, the viscosity of the releasing agent at around a fixing temperature may be too low, whereby sufficient peeling property may not be obtained. When a temperature at which the endothermic peak derived from the releasing agent is generated is higher than the range, the releasability during low temperature fixing may be deteriorated. Furthermore, when a temperature at which the endothermic peak derived from the releasing agent is generated is higher than 100° C. in particular, no matter how kneading conditions are controlled, the compatibility between the crystalline resin and releasing agent is not obtained, whereby the releasing agent may tend to be exposed at the toner surface during a pulverizing process.

The toner shows at least three endothermic peaks of the first endothermic peak, the second endothermic peak and the third endothermic peak in a heating process of differential scanning calorimetry. However, the toner may further have another endothermic peak.

The another endothermic peak may specifically be an endothermic peak that is obtained in the range of, for example, higher than 100° C. and 120° C. or less and derived from a releasing agent.

Furthermore, plural endothermic peaks may exist within a temperature range of any one of the first endothermic peak, the second endothermic peak and the third endothermic peak.

Differential scanning calorimetry of a toner may be conducted using, for example, a differential scanning calorimeter (trade name: DSC3110, THERMOANALYSIS SYSTEM 001, manufactured by Bruker AXS K.K.) in accordance with ISO 3146 (1985). Herein, a temperature of an endothermic peak means a temperature at a summit of an endothermic peak in a DSC (Differential Scanning calorimetry) curve obtained by the measurement.

In the following, components of a toner according to an exemplary embodiment of the invention will be detailed.

Crystalline Polyester Resin

The crystalline polyester resin is not particularly restricted as long as the temperature at which the first endothermic peak is generated falls within the above-mentioned range when the crystalline polyester resin is used in combination with an amorphous polyester resin, and the temperature at which the second endothermic peak is generated falls within the above-mentioned range. Specific examples of the crystalline polyester resin include those synthesized from, for example, a polyvalent carboxylic acid component and a polyvalent alcohol component.

Herein, the second endothermic peak derived from a crystalline polyester resin is not a stepwise endothermic variation but a distinct endothermic peak. In order to obtain a distinct endothermic peak, the crystalline polyester resin may be a polyester resin obtained by co-polymerizing 50% by weight or less of other components to a crystalline main chain.

The polyvalent carboxylic acid included as a constituent component of a crystalline polyester resin may be selected from, for example, various dicarboxylic acids. Among these, aliphatic dicarboxylic acids and aromatic dicarboxylic acids are desirable. As the aliphatic dicarboxylic acid, straight-chain carboxylic acids are particularly desirable. The dicarboxylic acid may be used singly as an acid-derived constituent component used in the invention, or two or more thereof may be used.

Examples of the aliphatic dicarboxylic acids include, but not limited to, oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid and 1,18-octadecane dicarboxylic acid, and lower alkyl esters thereof and anhydrides thereof. Of these, adipic acid, sebacic acid, and 1,10-decane dicarboxylic acid are preferred from the viewpoint of ready availability.

Examples of the aromatic dicarboxylic acids include terephthalic acid, isophthalic acid, orthophthalic acid, t-butyl isophthalic acid, 2,6-naphthalene dicarboxylic acid and 4-4'-biphenyl carboxylic acid. Among these, terephthalic acid, isophthalic acid and t-butyl isophthalic acid are preferred from the viewpoint of ready availability. An amount of the aromatic dicarboxylic acid included, as a constituent component, in a crystalline polyester resin is preferably 20% by mol or less, more preferably 10% by mol or less, and still more preferably 5% by mol or less. When an amount of the aromatic dicarboxylic acid exceeds 20% by mol, crystallinity of the resultant resin may be deteriorated, whereby image glossiness intrinsic to the crystalline polyester resin may not be obtained.

As a polyvalent alcohol included as a constituent component of a crystalline polyester resin, aliphatic diols are preferred, and straight-chain aliphatic diols having 7 to 22 carbon atoms are more preferred.

When an aliphatic diol is a branched aliphatic diol, the crystallinity of a polyester resin may be lowered, and a melting temperature thereof may be lowered, whereby toner blocking resistance, image storability and low temperature fixability may be deteriorated. Furthermore, when a straight-chain aliphatic diol has less than 7 carbon atoms, the melting temperature of the resin may become higher when the straight-chain aliphatic diol is polycondensed with an aromatic dicarboxylic acid, and a desired temperature at which an endothermic peak is generated may not be obtained. In other words, not only the low temperature fixability (fixing at, for instance, 110° C. or less) and high image glossiness may not be obtained but also miscibility with a releasing agent may be deteriorated, whereby the amount of a releasing agent exposed at the toner surface increases and the powder flowability may be deteriorated. On the other hand, when a straight-chain aliphatic diol has more than 20 carbon atoms, it is difficult to practically obtain the material thereof and not preferable from the viewpoint of cost thereof. The straight-chain aliphatic diol preferably has 14 or less carbon atoms.

Specific examples of the aliphatic diol include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Among these, ethylene glycol, 1,4-butanediol, 1,6-hexanediol, 1,9-nonanediol and 1,10-decanediol are preferred from the viewpoint of ready availability.

Of the polyvalent alcohols included as a constituent component in a crystalline polyester resin, a proportion of an aliphatic diol is preferably 80% by mol or more, and more preferably 90% by mol or more, and other polyvalent alcohol components may be included as required. When the proportion of an aliphatic diol is less than 80% by mol, the crystallinity of the polyester resin may be deteriorated, and the toner blocking resistance, image storability, low temperature fixability and image glossiness may be deteriorated.

As the other polyvalent alcohol components included as required, for example, constituent components derived from diols having a double bond may be used.

Examples of the diols having a double bond include 2-butene-1,4-diol, 3-hexene-1,6-diol and 4-octene-1,8-diol. A proportion of the constituent component derived from the diol having a double bond in the polyvalent alcohol component is preferably 20% or less by mol and more preferably 10% or less by mol. When the proportion exceeds 20% by mol, the crystallinity of the polyester resin may be deteriorated, whereby image storability may be deteriorated.

The melting temperature of the crystalline polyester resin is preferably in the range from 60 to 85° C. and more preferably in the range from 65 to 80° C. When the melting temperature is less than 60° C., since difference in the melting temperature of the crystalline polyester resin and that of the releasing agent is large, sufficient stirring and mixing become difficult; as the result, the releasing agent and the crystalline polyester resin may be hardly compatibilized, whereby a significant amount of the releasing agent may tend to be exposed at the toner surface. When the melting temperature exceeds 85° C., the compatibility of the crystalline polyester resin and the amorphous polyester resin may be deteriorated, whereby sufficient low temperature fixability and sufficient powder flowability may not be obtained.

An amount of the crystalline polyester resin in the toner is preferably from 1 to 40% by weight or from about 1 to about 40% by weight, and more preferably from 2 to 20% by weight or from about 2 to about 20% by weight. When the amount is less than 1% by weight, the low temperature fixability and image glossiness may not be obtained. On the other hand, when the amount exceeds 40% by weight, softness of the crystalline resin is likely to cause crushing of toner, or filming at a photoreceptor and image defects due to contamination of members such as a charging roll or a transfer roll may occur.

A method of producing a crystalline polyester resin is not particularly restricted. The crystalline polyester may be produced by a general polyester polymerization method in which an acid component and an alcohol component are reacted. For example, a direct polycondensation method, an ester exchange method, or the like may be used depending on the kind of monomers. When the acid component and the alcohol component are reacted, a molar ratio between them (acid component/alcohol component) is not uniquely defined because it varies depending on reaction conditions. However, the molar ratio (acid component/alcohol component) is preferably 1/1.

A crystalline polyester resin may be produced in such a manner that monomers are reacted, for example, at a polymerization temperature between 180 and 230° C., while the inside of a reaction system is decompressed as required, and water and alcohol generated during condensation are removed. When a monomer is not dissolved or compatibilized under a reaction temperature, a high boiling-point solvent is added as a dissolution aid to dissolve the monomer, and the dissolution aid may be distilled away in a polycondensation reaction. When a monomer having low compatibility is present in a polycondensation reaction, the monomer having low compatibility and an acid or an alcohol to be polycondensed with the monomer may be condensed in advance, followed by polycondensing the monomer with other monomers.

Examples of a catalyst used during the production of a crystalline polyester resin include: compounds of alkali metals such as sodium or lithium; compounds of alkaline earth metals such as magnesium or calcium; compounds of metals such as zinc, manganese, antimony, titanium, tin, zirconium or germanium; phosphorous acid compounds; phosphoric acid compounds; and amine compounds. Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenylphosphonium bromide, triethylamine or triphenylamine.

Furthermore, when a high resistance crystalline polyester resin of which electric resistance under a high temperature and high humidity (28° C. and 85%) environment is $1.0\times10^{14}$ to $1.0\times10^{16}\Omega$ is used as a crystalline polyester resin, the developability, transferability and charge amount storability become excellent in particular under a high temperature and high humidity environment. The high resistance crystalline polyester resin may be obtained when, among the polyvalent alcohol components and polyvalent carboxylic acid components, a polyvalent alcohol component and a polyvalent carboxylic acid component each having a carbon chain having 6 or more carbon atoms, and preferably those having a carbon chain having 9 or more carbon atoms are used.

The crystalline polyester resin preferably has a weight average molecular weight from 10,000 to 30,000 or from about 10,000 to about 30,000. When the weight average molecular weight is less than 10,000, the mechanical strength of the crystalline resin may be weak, and filming at a photosensitive material may occur. On the other hand, when the weight average molecular weight is larger than 30,000, the compatibility with an amorphous resin may become weak, and the ultralow temperature fixability and high glossiness may not be obtained.

Amorphous Polyester Resin

An amorphous polyester resin is not restricted as long as a temperature at which the first endothermic peak is generated falls within the above-mentioned range when the amorphous polyester resin is used in combination with the crystalline polyester resin. Specific examples of the amorphous polyester resin include those synthesized from polyvalent carboxylic acid components and polyvalent alcohol components.

Examples of the polyvalent alcohol components include bivalent alcohol components such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, bisphenol A or hydrogenated bisphenol A, and trivalent or higher-valent alcohol components such as glycerin, sorbitol, 1,4-sorbitan, and trimethylolpropane.

Examples of a bivalent carboxylic acid component that is condensed with the polyvalent alcohol component include maleic acid, maleic anhydride, fumaric acid, phthalic acid, terephthalic acid, isophthalic acid, malonic acid, succinic acid, glutaric acid and lower alkyl esters of these acids.

Examples of the polyvalent carboxylic acid component include, but not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid or 1,18-octadecanedicarboxylic acid, aromatic dicarboxylic acids including dibasic acids such as phthalic acid, isophthalic acid, terephthalic acid, naphthalene-2,6-dicarboxylic acid, malonic acid or mesaconic acid, and anhydrides thereof and lower alkyl esters thereof.

Examples of tri- or higher-valent carboxylic acid include 1,2,4-benzenetricarboxylic acid, 1,2,5-benzenetricarboxylic acid, 1,2,4-naphthalenetricarboxylic acid and anhydrides thereof and lower alkyl esters thereof. The carboxylic acids may be used singly or in a combination of at least two thereof. Furthermore, the amorphous polyester resin preferably includes, as an acid component, a dicarboxylic acid component having a sulfonic group in addition to the aliphatic dicarboxylic acids and the aromatic dicarboxylic acids. The dicarboxylic acid having a sulfonic group is effective in improving dispersion of a colorant such as a pigment.

Among the carboxylic acids, the polyvalent carboxylic acid component preferably includes an alkenyl succinic acid component (particularly preferably dodecenyl succinic acid component) from the viewpoint of excellent compatibility with a crystalline polyester resin and excellent ultralow temperature fixability. For example, an amorphous polyester resin including an alkenyl succinic acid component has good compatibility even with a crystalline polyester resin (for instance, a crystalline polyester resin obtained by polycondensation of a carboxylic acid component having 9 or more carbon atoms and an alcohol component having 9 or more carbon atoms) which has a high electric resistance even under a high temperature and high humidity environment (28° C. and 85%) but has poor compatibility with an amorphous resin. As the result, both of the ultralow temperature fixability and electric characteristics (such as developability, transferability and charging storability) under a high temperature and high humidity environment (28° C. and 85%) are satisfied.

An amount of the alkenyl succinic acid component in an amorphous polyester resin is preferably from 1 to 35% by weight or from about 1 to about 35% by weight, and more preferably from 5 to 30% by weight or from about 5 to about 30% by weight. When an amount of the alkenyl succinic acid component is less than 1% by weight, the alkenyl succinic acid component does not contribute to the compatibility with a crystalline polyester resin. Thus, when a high resistance crystalline resin such as that mentioned above is used in particular, the ultralow temperature fixability may not be obtained. On the other hand, when an amount of the alkenyl succinic acid exceeds 35% by weight, the glass transition temperature of an amorphous polyester resin does not reach 55° C. or more, resulting in poor thermal storability.

The glass transition temperature of the amorphous polyester resin is preferably from 50 to 68° C., more preferably from 53 to 65° C. and still more preferably 55 to 63° C.

The melting temperature of the amorphous polyester resin is preferably from 95 to 140° C., more preferably from 100 to 135° C. and still more preferably from 105 to 130° C.

The amorphous polyester resin preferably has a weight average molecular weight from 15,000 to 100,000 or from about 15,000 to about 100,000. When the weight average molecular weight is less than 15,000, resin elasticity may become too low, which may result in problems such as occurrence of offset during high temperature fixing (for instance, at 210° C.) and peeling defects. On the other hand, when the weight average molecular weight exceeds 100,000, the low temperature fixability and high glossiness may be deteriorated even when a large amount of an alkenyl succinic acid is used to improve the compatibility of the amorphous resin with a crystalline resin.

An amorphous polyester resin may be, depending on circumstances, a mixture of a low molecular weight amorphous polyester resin and a high molecular weight amorphous polyester resin. Herein, a low molecular weight amorphous polyester resin is a resin having a weight average molecular weight of 10,000 or more and less than 30,000, and a high molecular weight amorphous polyester resin is a resin having a weight average molecular weight of 30,000 or more and less than 100,000. When a mixed resin of a low molecular weight amorphous polyester resin and a high molecular weight amorphous polyester resin is used, an additional improvement in the peeling property and higher glossiness may be realized. An example of the mixed resin is a resin mixture obtained by mixing an amorphous polyester resin having a weight average molecular weight of about 18,000 and an amorphous polyester resin having a weight average molecular weight of about 80,000 at a ratio of 50/50.

Releasing Agent

As the releasing agent, known releasing agents may be used. Specific examples thereof include: low molecular weight polyolefins such as polyethylene, polypropylene or polybutene; silicones which may soften upon heating; aliphatic amides such as oleamide, erucamide, recinoleic amide or stearic amide; plant waxes such as carnauba wax, rice wax, candelilla wax, haze wax or jojoba oil; animal waxes such as bees wax; mineral waxes, petroleum waxes and synthetic waxes such as montan wax, ozokerite, ceresin, paraffin wax, microcrystalline wax or Fischer-Tropsch wax; and modified products thereof.

Further, in order that the temperature at which the third endothermic peak is generated falls within the above-mentioned temperature range, the melting temperature of the releasing agent to be used is desirably from 80 to 100° C. or from about 80 to about 100° C., and more desirably from 85 to 95° C. or from about 85 to about 95° C.

Still further, it is preferable to use, as the releasing agent, a paraffin wax having a melting temperature within the above-mentioned temperature range, whereby the mixing property (miscibility) of the releasing agent and the crystalline polyester resin during a kneading process may be improved, the amount of the releasing agent exposed on the toner surface after pulverization may be suppressed owing to the presence of the crystalline resin surrounding the releasing agent, and the powder characteristics may be superior to those of a toner having the same amount of the releasing agent exposed at the surface thereof.

When, in particular among the paraffin waxes, a Fischer-Tropsch wax having a melting temperature from 80 to 100° C. and more preferably from 85 to 95° C. is used, releasability and offset property in a high temperature region (for example, at 220° C.) may be improved even when printing is performed using image forming devices at any process speed from a low speed to a high speed region or even when a solid image is printed on a paper having a small basis weight.

The amount of the releasing agent in the toner is from 5 to 15% by weight, preferably from 6.5 to 13.5% by weight and more preferably from 8 to 12% by weight. When the amount is less than 5% by weight, offset may occur during high temperature fixing. On the other hand, when the amount exceeds 15% by weight, it becomes difficult to inhibit the releasing agent from being exposed at the toner surface even when the crystalline polyester resin and the amorphous polyester resin are selected and the kneading conditions are controlled so that the toner components are finely dispersed.

In addition to the releasing agent that contributes to the third endothermic peak, another releasing agent may be included in the toner to further improve high temperature releasability. The other releasing agent shows another endothermic peak. As the other releasing agent, for example, a releasing agent having a melting temperature that is from higher than 100° C. to 130° C. is used. The amount of the other releasing agent in the toner is preferably from 0.1 to 3% by weight. When the amount of the other releasing agent is more than 3%, releasability and offset property during low temperature fixing may be deteriorated. On the other hand, when the amount of the other releasing agent is less than 0.1% by weight, the other releasing agent may not display its effects. When the melting temperature of the other releasing agent is 100° C. or less, the high temperature releasability may not be obtained, while when the melting temperature of the releasing agent is 130° C. or more, offset at low temperatures may occur.

Colorant

The toner may include a colorant as required. Known colorants may be used as the colorant. Specific examples of the colorant include: various pigments such as carbon black, chrome yellow, hansa yellow, benzidine yellow, suren yellow, quinoline yellow, Permanent Yellow, Permanent Orange GTR, pyrazolone orange, vulcan orange, watch young red, Permanent Red, brilliant carmine 3B, brilliant carmine 6B, DuPont oil red, pyrazolone red, lithol red, Rhodamine B lake, lake red C, rose bengal, aniline blue, ultramarine blue, calco oil blue, methylene blue chloride, phthalocyanine blue, phthalocyanine green or malachite green oxalate; and various dyes such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, triphenylmethane dye, diphenylmethane dye or thiazole dye. These may be used singularly or in a combination of at least two kinds thereof.

In order to produce a magnetic toner, the colorant may be partially or entirely substituted with a magnetic material. Any one of known magnetic materials that have been so far generally used may be used. Specific examples thereof include: metals such as iron, cobalt or nickel and alloys thereof; metal oxides such as $Fe_3O_4$, $\gamma$-$Fe_2O_3$ or cobalt-added iron oxide; various kinds of ferrites such as MnZn ferrite or NiZn ferrite. A volume average particle diameter of the magnetic material is generally suitably in the range from 0.05 to 0.5 μm. Furthermore, the magnetic material may be surface-treated with a silane coupling agent or a titanium coupling agent to impart the chargeability and dispersibility to the magnetic material.

Other Components

The toner may further include, in addition to the above-mentioned components, any of various components such as an internal additive, a charge control agent, inorganic powder (inorganic particles) or organic particles, as required.

Examples of the internal additive include magnetic materials such as a ferrite, a magnetite, metals such as reduced iron, cobalt, nickel or manganese, alloys thereof and compounds containing any of these metals.

When a magnetic toner is produced using the magnetic material or the like, a ferromagnetic material has an average particle diameter of preferably 2 μm or less and more preferably from about 0.1 to about 0.5 μm. An amount of the magnetic material included in the toner is preferably from 20 to 200 parts by weight with respect to 100 parts by weight of a resin component, and particularly preferably from 40 to 150 parts by weight with respect to 100 parts by weight of a resin component. Furthermore, the magnetic material preferably has such magnetic characteristics, under application of 10 K Oe, as a magnetic coercive force (Hc) of from 20 to 300 Oe, a saturation magnetization ($\sigma s$) of from 50 to 200 emu/g and a residual magnetization ($\sigma r$) of from 2 to 20 emu/g.

Examples of the charge control agent include metal-containing dyes such as a tetra-fluorinated surfactant, a metal salicylate complex or an azo metal compound, high molecular weight acids such as a polymer containing maleic acid as a monomer component, a quaternary ammonium salt and an azine dye such as nigrosine.

The toner may include an inorganic powder to control viscoelasticity. Examples of the inorganic powder include all of the inorganic particles that are usually used as an external additive at a toner surface, which will be described below, such as silica, alumina, titania, calcium carbonate, magnesium carbonate, calcium phosphate or cerium oxide.

External Additive

An external additive may be externally added to a surface of a toner, as required. Examples of the external additive to be externally added to a toner surface include inorganic particles and organic particles, and specifically include the following inorganic particle and organic particles. In addition, external additives that are used in a production method described below may also be used.

Examples of the inorganic particles include silica, alumina, titanium oxide, barium titanate, magnesium titanate, calcium titanate, strontium titanate, zinc oxide, silica sand, clay, mica, wollastonite, diatomaceous earth, cerium chloride, colcothar, chromium oxide, cerium oxide, antimony trioxide, magnesium oxide, zirconium oxide, silicon carbide and silicon nitride.

The inorganic particles are generally used to improve the flowability. A primary particle diameter of the inorganic particles is desirably in the range from 1 to 200 nm, and an amount thereof is desirably in the range from 0.01 to 20 parts by weight with respect to 100 parts by weight of the toner.

The organic particles are generally used to improve the cleanability and transferability. Specific example thereof include fluororesin powders such as that of polyvinylidene fluoride or polytetrafluoroethylene, aliphatic acid metal salts such as zinc stearate or calcium stearate, polystyrene and polymethyl methacrylate.

Among the external additives, an inorganic oxide such as titania or silica is preferably used from the viewpoints of improving the flowability and charging characteristics. In the case where there is a difference in the affinities of the inorganic oxide to respective toner constituent materials (for instance, when there is a large difference between the affinity of the inorganic oxide to the releasing agent and the affinity thereof to the binder resin), the external additive may tend to localize at the toner surface when an amount of the releasing agent or crystalline resin which is exposed at the toner surface is large. However, the exposure of the releasing agent and crystalline resin at the toner surface is suppressed in the toner of the exemplary embodiment, as mentioned above, whereby the localization of the external additive may also be inhibited from occurring.

Examples of the inorganic oxides that are likely to cause the localization of the external additive (i.e., inorganic oxides that have different affinities to respective toner constituent materials) include untreated titania or silica, and silane coupling agent- or silicone oil-treated titania or silica. In particular, an inorganic oxide having a primary particle diameter exceeding 30 nm highly likely tends to cause the localization.

An amount of the inorganic oxide to be externally added is preferably from 0.1 to 5 parts by weight per one kind of inorganic oxide with respect to 100 parts by weight of the toner particles before the external addition. When the amount of the inorganic oxide to be externally added is less than 0.1 parts by weight, effects of the external additive on improvement in the flowability and charging property may not be sufficiently exerted. Meanwhile, when the amount is more than 5 parts by weight, especially when the external additive is titania, sufficient chargeability may not be imparted to the toner.

Toner Characteristics

Amount of Releasing Agent present at Toner Surface

The amount of a releasing agent present at a toner surface is, as mentioned above, from 10 to 35% by weight and preferably from 15 to 30% by weight. When the ratio of a releasing agent present at a toner surface exceeds 35%, the powder flowability may not be obtained; accordingly, defects such as stripes, contamination and toner dispensing defects, which are caused by trickle-down of the toner, may be caused. Meanwhile, when the ratio of a releasing agent present at a toner surface is less than 10%, although there may be no problem during normal usage, elution of the releasing agent tends to delay during fixing. In particular, when a paper having a small basis weight is used in a high-speed fixing (e.g., at a process speed of 300 m/sec), the releasability of a solid image with a leading edge at 0 mm may be poor.

The ratio of the releasing agent present at the toner surface may be determined by an X-ray Photoelectron Spectroscopy (XPS) measurement. The XPS measurement may be conducted using an X-ray photoelectron spectrometer (trade name: JPS9000 MX, manufactured by JOEL Ltd.) under measurement conditions of an acceleration voltage of 10 kV and a current value of 30 mA.

Furthermore, the ratio of the releasing agent present at the toner surface may be obtained from the results obtained by the XPS measurement, as follows. Specifically, elemental ratios are identified from thus-obtained wavelengths and measurement values of count numbers; in particular, an elemental ratio ("O"/"C+O") between "C" (carbon atoms) and "O" (oxygen atoms) is calculated. Hereinafter, the term "elemental ratio" refers to an elemental ratio between carbon atoms and oxygen atoms unless otherwise noted. The elemental ratio in each of the resins, releasing agent and toner are obtained, and the ratio of the releasing agent present at a toner surface is then accurately calculated. For instance, an elemental ratio "W" of a releasing agent is represented by W=WO/(WC+WO), with the carbon atom "C" included in the releasing agent represented by "WC", and the oxygen atom "O" represented by "WO". The elemental ratio "R" of a resin is represented by R=RO/(RC+RO), with the carbon atom "C" included in the resin represented by "RC", and the oxygen atom "O" represented by "RO". Further, the elemental ratio "T" of a toner is represented by T=TO/(TC+TO), with the carbon atom "C" included in the toner represented by "TC", and the oxygen atom "O" represented by "TO". The ratio of the releasing agent present at the toner surface is represented by the following expression.

"Ratio of Releasing Agent Present at Toner Surface (%)=$(R-T)/(R-W)\times 100$"

When an external additive adheres to a surface of a toner particle, the external additive has to be removed by the method described below, prior to the XPS measurement. Specifically, a few drops of a surfactant such as CONTAMINON (trade name, manufactured by Wako Pure Chemical Industries Ltd.) are added to ion-exchanged water, the toner is added thereto to wet, mix and disperse the toner. Thereafter, an ultrasonic wave is applied for 1 to 5 min to remove the external additive. Thereafter, a dispersion liquid obtained by mixing and dispersing the toner is filtered with a filter paper, followed by rinsing. Then, after the toner on the filter paper is dried, the XPS measurement is conducted.

Shape Factor SF1

The toner has a shape factor SF1 preferably from 138 to 155 and more preferably from 142 to 150 from the viewpoint of providing cleanability. When the shape factor SF1 is less than 138, there may be no problem in the blade cleanability in a usual usage region; however, the blade cleanability in an ultrahigh-speed process (e.g., at a process speed of 300 mm/sec) may be deteriorated. In particular, the blade cleanability may be deteriorated, for example, when a toner that has been deteriorated by printing of about 10,000 sheets is to be cleaned, when the toner is used under an environment in which a low temperature and low humidity environment (for example, at a temperature of 10° C. and a humidity of 30%) and a high temperature and high humidity environment (for example, at a temperature of 30° C. and a humidity of 90%) are repeatedly alternated, when the process speed is 300 mm/sec or more, or when a curvature of a photoreceptor is large. On the other hand, a toner having a shape factor SF1 of more than 155 is difficult to prepare, and the transferability of such a toner may be remarkably deteriorated.

Herein, the "shape factor SF1" is an average value obtained in such a manner that a specific number (such as 100 particles) of a toner (toner particles) is subjected to image analysis, shape factors SF1 of the photographed toner (toner particles) are determined in accordance with the following formula, respectively, and the thus-obtained values are averaged. In the following formula, ML represents the absolute maximum length of a toner particle, and A represents a projected area of the toner particle.

$$\text{Shape factor SF1}(\%)=(ML^2/A)\times(\pi/4)\times 100$$

The shape factor SF1 is a factor that numerically expresses mainly a microscopic image or a scanning electron microscopic (SEM) image and is obtained by analyzing the image using an image analyzer. For instance, the shape factor SF1 is obtained as described below.

First, toner particles are dispersed on a slide glass, and an image thereof is taken through an optical microscope using a video-camera. The image is transferred to a LUZEX image analyzer (trade name, manufactured by Nireco Corporation), the absolute maximum length and the projected area of each of 100 or more toner particles are obtained, and a shape factor SF1 is obtained as an average values thereof by the calculation in accordance with the above formula.

Volume Average Particle Diameter (D50T)

A volume average particle diameter (D50T) of the toner is preferably from 5 to 9 μm, more preferably from 5.5 to 8 μm and still more preferably from 5.5 to 7 μm.

When the volume average particle diameter of the toner is less than 5 μm, the developability and transferability may start deteriorating because of a large amount of charges, background fogging may be generated, and image quality deterioration due to low transfer efficiency may be caused. On the other hand, when the volume average particle diameter of the toner exceeds 9 μm, high-fidelity reproducibility of an electrostatic latent image to be formed on a photoreceptor starts deteriorating because of scattering of the toner or the like, which may result in an image having an inferior fine line reproducibility and inferior granularity.

Method of Producing Toner

A method of producing a toner according to an exemplary embodiment of the invention includes: a process for kneading a toner forming material including the amorphous polyester resin, the crystalline polyester resin and the releasing agent; a process for cooling a kneaded material formed by the kneading process; and a process for pulverizing the kneaded material which has been cooled by the cooling process, and may include other processes as required.

In what follows, each of the processes of the method of producing the toner according to the exemplary embodiment will be described.

Kneading Process

The kneading process at least includes, with a temperature at which the third endothermic peak is generated being represented by "Ta" and the melting temperature of the amorphous polyester resin being represented by "Tm": a first kneading process in which the toner forming material is kneaded at a temperature from "Ta −10° C." to "Ta +10° C." or from about "Ta −10° C." to about "Ta +10"C"; and a second kneading process in which the toner forming material kneaded in the first kneading process is kneaded at a temperature from "Tm −10° C." to "Tm +20° C." or from about "Tm −10° C." to about "Tm +20° C.".

When there are plural third endothermic peaks, a temperature in the first kneading process may be set as follows. Specifically, a peak which is generated at the lowest temperature among the plural peaks is represented by "Ta", and the temperature in the first kneading process is from "Ta −10° C." to "Ta +10° C.".

When plural amorphous polyester resins are used, a temperature in the second kneading process is set as follows. Specifically, a melting temperature of a resin having the highest melting temperature among the plural amorphous polyester resins is represented by "Tm", and a temperature in the second kneading process is from "Tm −10° C." to "Tm +20° C.".

When a temperature in the first kneading process is set in the range, a releasing agent and a crystalline polyester resin are compatibilized, whereby in the toner forming material, a mixture in which the releasing agent is coated by the crystalline polyester resin is formed. As the result, the selective crack (pulverization) at the interfaces between the releasing agent and the binder resin hardly occurs in a later pulverization process, and an amount of the releasing agent exposed at the surface of the produced toner may be suppressed.

When a temperature in the first kneading process is lower than Ta −10° C., the releasing agent is not sufficiently melted, it is difficult to attain the compatibility between the releasing agent and the crystalline polyester resin, whereby the selective crack at the interfaces of the releasing agent in a later pulverization process may hardly be controlled. Meanwhile, when a temperature in the first kneading process is higher than Ta +10° C., the viscosity of the crystalline polyester resin may become excessively low to result in insufficient compatibility (insufficient mixing and dispersion) of the releasing agent and the crystalline polyester resin.

Furthermore, when a temperature in the second kneading process is set within the range, the mixture formed by the first kneading process (mixture in which the releasing agent is coated by the crystalline polyester resin) is dispersed in the amorphous polyester resin. Accordingly, in a later pulverization process, the selective crack (pulverization) hardly occurs at the interfaces between the releasing agent and the binder resin and at the interfaces between the crystalline polyester resin and the amorphous polyester resin. As the result, amounts of the releasing agent and the crystalline polyester resin exposed at the surface of the produced toner may be suppressed.

When a temperature in the second kneading process is lower than Tm −10° C., the amorphous polyester resin is not sufficiently melted; accordingly, the compatibility of the mixture and the amorphous polyester resin may be insufficient. Meanwhile, when a temperature in the second kneading process is higher than Tm +20° C., the viscosity of the mixture becomes excessively low; accordingly, the compatibility (dispersion and mixing) of the mixture and the amorphous polyester resin may not be sufficient, whereby the mixture may be localized in the amorphous polyester resin.

In the second kneading process, an aqueous medium (for example, water such as distilled water or ion exchanged water, or alcohols) is desirably added in an amount from 0.5 to 5 parts by weight (or from about 0.5 to about 5 parts by weight) with respect to 100 parts by weight of the toner forming material. When an aqueous medium is added, an evaporative latent heat of the aqueous medium lowers the temperature of the molten toner forming material (hereinafter, may be referred to as "molten product"). That is, in the second kneading process, self heating caused by the kneading may sometimes make the temperature of the molten product higher than the preset temperature. However, the latent heat of vaporization of the added aqueous medium inhibits the temperature rise, whereby the temperature of the molten product may be appropriately maintained. As the result, the viscosity of the molten product is favorably maintained, and sufficient shear (shearing force) is imparted to the molten product. Thereby, the mixture (mixture of the releasing agent and the crystalline polyester resin) is finely dispersed in the amorphous polyester resin, the selective crack at the interfaces thereof is inhibited from occurring in the later pulverization process, whereby the exposure of the releasing agent at the toner surface is further inhibited.

When an amount of an aqueous medium to be added in the second kneading process is less than 0.5 parts by weight, an effect of lowering the temperature of the molten product when an aqueous medium is added may be too small. On the other hand, when an amount of the aqueous medium is larger than 5 parts by weight, the aqueous medium and the molten product may be insufficiently mixed, and the aqueous medium that has not been sufficiently mixed with the molten product may not lower the temperature of the molten product. Furthermore, when an amount of the aqueous medium is excessive, the aqueous medium remains without vaporizing in the second kneading process, and the remaining aqueous medium does not contribute to lowering the temperature of the molten product as well. Accordingly, even when an amount of the aqueous medium is more than 5 parts by weight, the effect of lowering the temperature of the molten product may not be obtained.

The addition of the aqueous medium in the second kneading process may be performed, specifically, for example, after the first kneading process has been completed and before the second kneading process is started, simultaneously with the start of the second kneading process, or after the second kneading process has been started. That is, the timing when the aqueous medium is added is not particularly restricted as long as the aqueous medium and the molten product are mixed in at least a part of the second kneading process. The timing when the aqueous medium is added may be controlled depending on the desired level of the effect of lowering the temperature of the molten product. Accordingly, the aqueous medium is preferably added after the completion of the first kneading process and before the start of the second kneading process, or simultaneously with the start of the second kneading process, from the viewpoint of exerting the effect of lowering the molten product temperature at a maximum.

Examples of a kneader used in the kneading process include a monoaxial extruder and a biaxial extruder. In what follows, as an example of a kneader to be used in the invention, a kneader having a feed screw portion and two kneading portions will be described with reference to the drawings. However, the kneader to be used in the invention is not restricted thereto.

FIG. 1 is a diagram showing a state of a screw of an example of a screw extruder that is used in a kneading process in a toner production method according to an exemplary embodiment of the invention.

Screw extruder 11 includes barrel 12 provided with a screw (not shown), injection port 14 from which a toner forming material that is a toner raw material is injected into barrel 12, liquid addition port 16 from which an aqueous medium is added to the toner forming material in barrel 12, and ejecting port 18 from which a kneaded material formed by kneading the toner forming material in barrel 12 is ejected.

Barrel 12 is divided, in order from a side near injection port 14, into feed screw portion SA through which the toner forming material injected from injection port 14 is transferred into kneading portion NA, kneading portion NA in which the toner forming material is melted and kneaded under the conditions of the first kneading process, feed screw portion SB through which the toner forming material that has been melt-kneaded in kneading portion NA is transferred into kneading portion NB, kneading portion NB in which a kneaded material is formed by melt-kneading the toner forming material under the conditions of the second kneading process, and feed screw portion SC through which a resultant kneaded material is transferred to ejection port 18. Feed screw portion SA, feed screw portion SB, and feed screw portion SC each have a screw that transfers the toner forming material to subsequent portions thereof.

The inside of barrel 12 is divided into plural blocks, and the blocks have temperature controllers (not shown) different from one another, respectively. That is, for example, barrel 12 may have blocks 12A to 12J, and blocks 12A to 12J may be controlled at different temperatures from each other. FIG. 1 shows a state in which temperatures of block 12A and block 12B are controlled to t0° C., temperatures of from block 12C to block 12E are controlled to t1° C., and temperatures of from block 12F to block 12J are controlled to t2° C., respectively. Accordingly, the toner forming material present in kneading portion NA is heated to t1° C., and the toner forming material present in kneading portion NB is heated to t2° C. As mentioned above, the temperature t1° C. in kneading portion NA is from Ta −10° C. to Ta +10° C., and the temperature t2° C. in kneading portion NB is from Tm −10° C. to Tm +20° C.

When the toner forming material which contains a crystalline polyester resin, an amorphous polyester resin, and a releasing agent and may contain a colorant, as required, is fed from injection port 14 into barrel 12, the toner forming material is transferred to the kneading portion NA through the feed screw portion SA. At this time, the temperature of block 12C is set at t1° C. (a temperature within a range from Ta −10° C. to Ta +10° C.); accordingly, the toner forming material is transferred into kneading portion NA in a state changed to a molten state by heating. Then, since temperatures of block 12D and block 12E are also set at t1° C., the toner forming material is melted and kneaded at a temperature of t1° C. in kneading portion NA. That is, the crystalline polyester resin and releasing agent that are melted at a temperature lower than a melting temperature of the amorphous polyester resin are melted in kneading portion NA and receive the shearing force generated by the screw. Accordingly, a mixture of the crystalline polyester resin and the releasing agent is homogeneously and finely dispersed, together with a colorant, in the amorphous polyester resin that is not melted. Further, since the crystalline polyester resin, in particular, has a lower viscosity than that of the releasing agent, the crystalline polyester resin is present around the releasing agent.

Subsequently, the toner forming material that has undergone the first kneading process in kneading portion NA is transferred to kneading portion NB through feed screw portion SB.

In kneading portion NB, since temperatures of from block 12F to block 12J are set at t2° C. (a temperature within a range from Tm −10° C. to Tm +20° C.), the amorphous polyester resin is melted, and the mixture of the crystalline polyester resin and the releasing agent, which have been melt-mixed in the first kneading process, and the colorant or the like are dispersed in the amorphous polyester resin.

In the second kneading process, as mentioned above, the temperature of the toner forming material may sometimes become higher than the preset temperature because of the self-heating caused by kneading. When the temperature of the toner forming material is excessively high, the viscosity of the toner forming material becomes excessively low; accordingly, hardly any kneading shearing force may be applied to the toner forming material, whereby dispersion of the releasing agent and crystalline polyester resin in the amorphous polyester resin may be deteriorated. On the other hand, when brine or the like is used to cool the screw to inhibit a temperature increase, the cooling may be insufficient because the pipe or the like through which the brine flows has a small surface area. In this regard, as a method of inhibiting temperature increase, a method of directly depriving heat from inside of a toner forming material by pouring a liquid into to the toner forming material is particularly effective in lowering the viscosity of the toner forming material and increasing the kneading share.

Specifically, in feed screw portion SB, an aqueous medium is added to the toner forming material by injecting the aqueous medium from liquid addition port 16 into barrel 12. Examples of the aqueous medium to be injected from liquid addition port 16 include, as mentioned above, distilled water, ion-exchanged water, ethanol and methanol. Furthermore, although FIG. 1 shows an exemplary embodiment in which an aqueous medium is injected in feed screw portion SB, the injection of an aqueous medium is not limited thereto. For example, an aqueous medium may be injected in kneading portion NB, or an aqueous medium may be injected in both of feed screw portion SB and kneading portion NB. That is, positions and a number of positions at which the aqueous medium is injected are selected as required.

As mentioned above, when an aqueous medium is injected from liquid addition port 16 into barrel 12, the toner forming material in barrel 12 and an aqueous medium are mixed, and the toner forming material is cooled by latent heat of vaporization of the aqueous medium, whereby a temperature of the toner forming material in the second kneading process may be appropriately maintained. As the result, the releasing agent may be more finely dispersed in the amorphous polyester resin in the second kneading process.

Finally, a kneaded material formed by melt-kneading in kneading portion NB is transferred by feed screw portion SC to ejection port 18 and ejected from ejection port 18.

As mentioned above, a kneading process in which screw extruder 10 is used as shown in FIG. 1 is conducted.

Cooling Process

In the cooling process, the kneaded material formed in the kneading process is cooled. In the cooling process, a kneaded material is preferably cooled from a temperature of the kneaded material at the time of completion of the kneading process to 40° C. or less or about 40° C. or less at an average temperature-decrease speed of 4° C./sec or more or about 4° C./sec or more. When the cooling speed of the kneaded material is slow, the mixture (a mixture of a releasing agent and a crystalline polyester resin) that has been finely dispersed in the amorphous polyester resin in the kneading process may be recrystallized, resulting in large dispersion diameter. In contrast, rapid cooling at the above average temperature-decrease speed is preferred because the dispersion state immediately after the completion of the kneading process is appropriately maintained as it is. The average temperature-decrease speed indicates an average value of the speed when a kneaded material is cooled from a temperature of the kneaded material at the completion of the kneading process (for instance, t2° C. when a screw extruder 11 of FIG. 1 is used) to 40° C.

As a cooling method in the cooling process, a method using, for example, a mill roll in which cold water or brine is circulated or an insertion cooling belt is specifically used. When cooling is performed by the method, the cooling speed thereof is determined by a speed of a mill roll, a flow rate of brine, a feed amount of the kneaded material and a slab thickness at rolling of the kneaded material. A slab thickness is preferably from 1 to 3 mm.

Pulverization Process

The kneaded material that has been cooled in the cooling process is pulverized by a pulverization process to form toner particles. In the pulverization process, for instance, a mechanical pulverizer or a jet pulverizer is used.

In the pulverization process, an inorganic oxide in an amount from 0.1 to 5 parts by weight or from about 0.1 to about 5 parts by weight is preferably added with respect to 100 parts by weight of the kneaded material. When the inorganic oxide is added to the kneaded material in the pulverization process, localization of an external additive, which is caused by a releasing agent and a crystalline polyester resin that are exposed at a toner surface, may be inhibited from occurring. Furthermore, in the case where one kind of inorganic oxide is uniformly attached to a toner surface in the pulverization process, even when another inorganic oxide (for example, a spherical external additive which has a large diameter and remarkably tends to localize at a toner surface) is externally added later, the other inorganic oxide is inhibited from localizing at the toner surface, resulting in an improvement in the charging property, transferability and powder flowability.

An amount of an inorganic oxide to be added is preferably from 0.1 to 5 parts by weight and more preferably from 0.2 to 2 parts by weight, with respect to 100 parts by weight of the kneaded material. When the amount of the inorganic oxide is less than 0.1 parts by weight, the advantage thereof may not be obtained. On the other hand, when the amount of the inorganic oxide exceeds 5 parts by weight, depending on the kind of the inorganic oxide, the charging amount may decrease, and an amount of inorganic oxide to be attached may hardly be controlled.

As the inorganic oxide to be added in the pulverization process, an inorganic oxide that is same as the external additive used in ordinary toner may be used. Specifically, the inorganic oxide may be, for example, formed of a core material or a core layer having a coating layer thereon, which is provided by treating a surface of the core material with a treatment agent.

Examples of the core material include titania, a titanium compound, silica, alumina, and tin oxide. When the inorganic oxide is used in a color toner in particular, a colorless or light-colored inorganic oxide that does not disturb a colorant is preferred. A treatment agent is used to impart chargeability, reduce difference in developability under different environments and impart admix property, and, for example, a silane compound such as a silane coupling agent is used. As the silane compound, for example, any one of chlorosilane, alkoxysilane, silazane, a special silylation agent may be used.

Specific examples of the silane compound include, but not limited to, methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltriethoxysilane, hexamethyldisilazane, N,O-(bistrimethylsilyl) acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, mercaptopropyltrimethoxysilane and γ-chloropropyltrimethoxysilane.

An average primary particle diameter of the inorganic oxide is preferably from 5 to 150 nm and more preferably from 10 to 50 nm. When the particle diameter exceeds 150 nm, the inorganic oxide may be weakly attached and fixed to the toner, and may be detached in the following collection and classification process.

Classification Process

The toner obtained in the pulverization process may be classified, as required, by a classification process to obtain toner particles having desired particle diameters. In the classification process, a conventional centrifugal classifier or inertia classifier is used to remove fine particles (toner particles having particle diameters smaller than the desired particle diameters) and coarse particles (toner particles having particle diameters larger than the desired particle diameters). The particle size distribution of the toner is preferably 1.3 or less in terms of GSDv. When the GSDv exceeds 1.3, a large amount of coarse particles may be included, whereby toner impaction to the carrier may occur, and image quality or granularity may be unfavorably deteriorated.

Herein, the value of the GSDv is calculated as described below. First, the particle size distribution of a toner is measured using MULTI-SIZER II (trade name, manufactured by Beckmann-Coulter Corporation) as a measurement device. The measured particle size distribution is depicted as a cumulative distribution of volumes of individual toner particles from a smaller particle size side relative to divided particle size ranges (channels). A particle diameter at which accumulation is 16% is defined as the volume average particle diameter D16v, the particle diameter at which accumulation is 84% is defined as D84v, and the volume average particle size distribution index GSDv is defined as $(D84v/D16v)^{1/2}$.

External Addition Process

To the resultant toner particles, in addition to the inorganic oxide that has been added in the pulverization process, inorganic particles such as silica, titania, and aluminum oxide may be added and attached to control chargeability, impart flowability, and impart charge exchangeability, for example. The external addition process is conducted stepwise using, for example, a V-blender, a Henschel mixer or a Redige mixer.

Examples of the inorganic particle include silica, alumina, titanium oxide, barium titanate, magnesium titanate, calcium titanate, strontium titanate, zinc oxide, silica sand, clay, mica, wollastonite, diatomaceous earth, cerium chloride, colcothar, chromium oxide, cerium oxide, antimony trioxide, magnesium oxide, zirconium oxide, silicon carbide and silicon nitride. Among these, silica particles are preferred, and hydrophobicized silica particles are particularly preferred.

The inorganic particles are generally used to improve the flowability. Among the inorganic particles, meta-titanic acid $TiO(OH)_2$ does not adversely affect the transparency and provides a developer that is excellent in the chargeability, environmental stability, flowability and caking resistance, and stable in the negative chargeability and image maintainability. In addition, a hydrophobicized compound of meta-titanic acid has electric resistance of $10^{10}$ Ω·cm or more; accordingly, when the hydrophobicized compound of meta-titanic acid is used in a toner, high transferability is preferably obtained without generating oppositely charged toner particles even when a transfer electric field is raised.

Regarding a volume average particle diameter of an external additive in the case of imparting flowability to a toner, the external additive has a primary particle diameter of preferably from 1 to 40 nm and more preferably from 5 to 20 nm. A volume average particle diameter of an external additive in the case of imparting transferability to a toner is preferably from 50 to 500 nm. The external additive particles are preferably subjected to surface treatment such as hydrophobicization from the viewpoint of stabilizing the chargeability and developability.

The surface treatment may be performed by any of conventionally known methods. Specifically, a coupling treatment using a silane, a titanate, an aluminate, or the like can be used. Examples of the coupling agent to be used for the coupling treatment include, but not particularly limited to, silane coupling agents such as methyltrimethoxysilane, phenyltrimethoxysilane, methylphenyldimethoxysilane, diphenyldimethoxysilane, vinyltrimethoxysilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane and hexamethyldisilazane, titanate coupling agents, and aluminate coupling agents.

Furthermore, various additives may be added, as required. Examples of the additive agent include other fluidizing agents, cleaning aids such as polystyrene particles, polymethyl methacrylate particles or polyvinylidene fluoride particles, and polishing agents for removing attached photosensitive material, such as zinc stearyl amide, strontium titanate or cerium oxide.

Examples of a lubricant which can be added include fatty acid amides such as ethylene bisstearyl acid amide or oleic acid amide, and fatty acid metal salts such as zinc stearate or calcium stearate.

An amount of the external additive is preferably in the range from 0.1 to 5 parts by weight (that is, 0.1 to 5 parts by weight including an amount of the inorganic oxide added at pulverization), and more preferably in the range from 0.3 to 3 parts by weight, with respect to 100 parts by weight of a toner having no external additive added. When the amount is less than 0.1 parts by weight, the flowability of a toner may be insufficient, and, furthermore, defects such as insufficient charge endowment and poor charge exchangeability may be disadvantageously caused. On the other hand, when the amount exceeds 5 parts by weight, a toner is coated by an excessive amount of the external additive, which may result in transfer of the excessive inorganic oxide to a member that is in contact with the toner to cause a secondary problem.

Furthermore, in an exemplary embodiment of the invention, particles having an average particle diameter from 40 to 150 nm are preferably externally added to a toner particle surface to improve toner storability. When the average particle diameter is less than 40 nm, a sufficient improvement in the storability may not be obtained. On the other hand, when the average particle diameter exceeds 150 nm, the particles may not be strongly attached to the toner surface; accordingly, the particles may easily be detached from the toner particle surface, whereby contamination to a carrier may be caused, a photoreceptor surface may be damaged, or the filming may be caused.

Specific examples of the external additive used to improve the storability include particles made of inorganic oxides such as silica, titania, zinc oxide, strontium oxide, aluminum oxide, calcium oxide, magnesium oxide, cerium oxide or composite oxide thereof, and organic particles made of a vinyl resin, a polyester resin or a silicone resin.

Among these, silica and titania are used preferably from the viewpoints of the particle diameter, particle size distribution, and manufacturability, and spherical silica particles prepared by use of a sol-gel method are particularly preferred.

An amount of the external additive with respect to the toner is not particularly restricted. However, the amount is preferably in the range from 0.1 to 10 parts by weight, and more preferably in the range from about 0.3 to about 5 parts by weight, with respect to 100 parts by weight of the toner before the external additive is added.

Sieving Process

A sieving process may be performed after the external addition process, as required. Examples of a specific sieving method to be used include a method that uses a gyro sifter, a vibration sifter, a wind sifter, or the like. By a sieving process, coarse particles of the external additive are removed, whereby stripes and trickling down contamination may be inhibited from occurring.

The toner according to the exemplary embodiment of the invention is produced as described above.

A developer for electrostatic charge image development (hereinafter, may sometimes be referred to as "electrostatic charge image developer") according to an exemplary embodiment of the invention may be used as a single component developer as it is or may be prepared into a two-component developer. When the electrostatic charge image developer is prepared into a two-component developer, the electrostatic charge image developer is mixed with a carrier. In exemplary embodiments, the toner may be used as either a single component developer that is used in a single component developing method or a two-component developer that is used in a two-component developing method. However, in an exemplary embodiment, the toner is preferably combined with a resin-coated carrier, and used as a two-component developer. When a resin-coated carrier is used as a carrier, deterioration of charge build-up and charge distribution, which are caused by a smaller particle size of a toner, and base contamination and density irregularity, which are caused by lowering of a charge amount, may be improved.

Electrostatic Latent Image Developer

An electrostatic latent image developer (hereinafter, may be referred to as "developer") according to an exemplary embodiment of the invention is not particularly restricted as long as it includes a toner according to an exemplary embodiment of the invention. The developer may be either a single component developer that includes the toner alone or a two-component developer that includes the toner and a carrier. In the case of the single component developer, a toner containing magnetic metal particles or a non-magnetic single component toner that does not contain magnetic metal particles may be used.

The carrier is not restricted particularly as long as it is a known carrier, and examples thereof include an iron powder carrier, a ferrite carrier and a surface-coated ferrite carrier. To the carriers, powders may be added. The powders that are added to the carriers may be surface treated as desired.

Specific examples of the carrier include carriers having a nucleus particle coated with any of the resins described below. The nucleus particle of the carrier may be made of an iron powder, a ferrite, a granulated magnetite, or the like, and a volume average particle diameter of the nucleus particle is in the range from about 30 to about 200 μm.

Examples of the coating resin of the resin-coated carrier include homopolymers or copolymers made of at least two of: styrenes such as styrene, p-chlorostyrene or α-methylstyrene; α-methylene fatty acid monocarboxylate such as methyl acrylate, ethyl acrylate, n-propyl acrylate, lauryl acrylate, 2-ethylhexyl acrylate, methyl methacrylate, n-propyl methacrylate, lauryl methacrylate or 2-ethylhexyl methacrylate; nitrogen-containing acryls such as dimethylaminoethyl methacrylate; vinyl nitriles such as acrylonitrile or methacrylonitrile; vinyl pyridines such as 2-vinylpyridine or 4-vinylpyridine; vinyl ethers such as vinyl methyl ether or vinyl isobutyl ether; vinyl ketones such as vinyl methyl ketone, vinyl ethyl ketone or vinyl isopropenyl ketone; olefins such as ethylene or propylene; fluorine-containing vinyl monomers such as vinylidene fluoride, tetrafluoroethylene or hexafluoroethylene, as well as silicone resins including methyl silicone and methylphenyl silicone, polyesters including bisphenol and glycol, epoxy resins, polyurethane resins, polyamide resins, cellulose resins, polyether resins, and polycarbonate resins. These resins may be used singularly or in a combination of at least two kinds thereof. An amount of the coating resin is preferably in the range from about 0.1 to about 10 parts by weight, and more preferably in the range from about 0.5 to about 3.0 parts by weight, with respect to 100 parts by weight of the nuclear particles.

The carrier is produced using, for example, a heating kneader, a heating Henschel mixer, or a UM mixer. Depending on the amount of the coating resin, a heating fluidized bed or a heating kiln may be used.

When a carrier is used which is formed by coating a ferrite particle as a nuclear particle with a resin in which, for example, carbon black as an electroconductive agent and/or melamine beads as a charge control agent are dispersed in methyl acrylate or ethyl acrylate and styrene, the resistance controllability may be excellent even in a thick coated layer; accordingly, image quality and image quality maintainability may be more excellent.

A mixing ratio of the toner and the carrier in the developer is not particularly restricted and may be selected depending on the purpose.

Image Forming Device

Next, an image forming device in which the electrostatic charge image developing toner of the exemplary embodiment is used will be described.

An image forming device according to an exemplary embodiment of the invention includes: a latent image carrier; a developing device that develops an electrostatic latent image formed on the latent image carrier into a toner image using a developer; a transfer device that transfers the toner image formed on the latent image carrier onto a transfer receiving body; a fixing device that fixes the toner image transferred onto the transfer receiving body; and a cleaning device (toner removing device) that scrubs the latent image carrier with a cleaning member to remove a residual component left after the transfer, and uses an electrostatic charge image developer of the invention as the developer.

In the image forming device, for instance, a portion including the developing device may be formed into a cartridge structure (process cartridge) that can be detachably mounted on an image forming device body. As the process cartridge, a process cartridge according to an exemplary embodiment of the invention, which is provided with at least a developer carrier and houses an electrostatic charge image developer of the invention, is preferably used.

In what follows, an example of the image forming device of the exemplary embodiment will be described. However, the invention is not restricted thereto. Main portions shown in the drawing will be described, and descriptions of other portions will be omitted.

Figure 2:
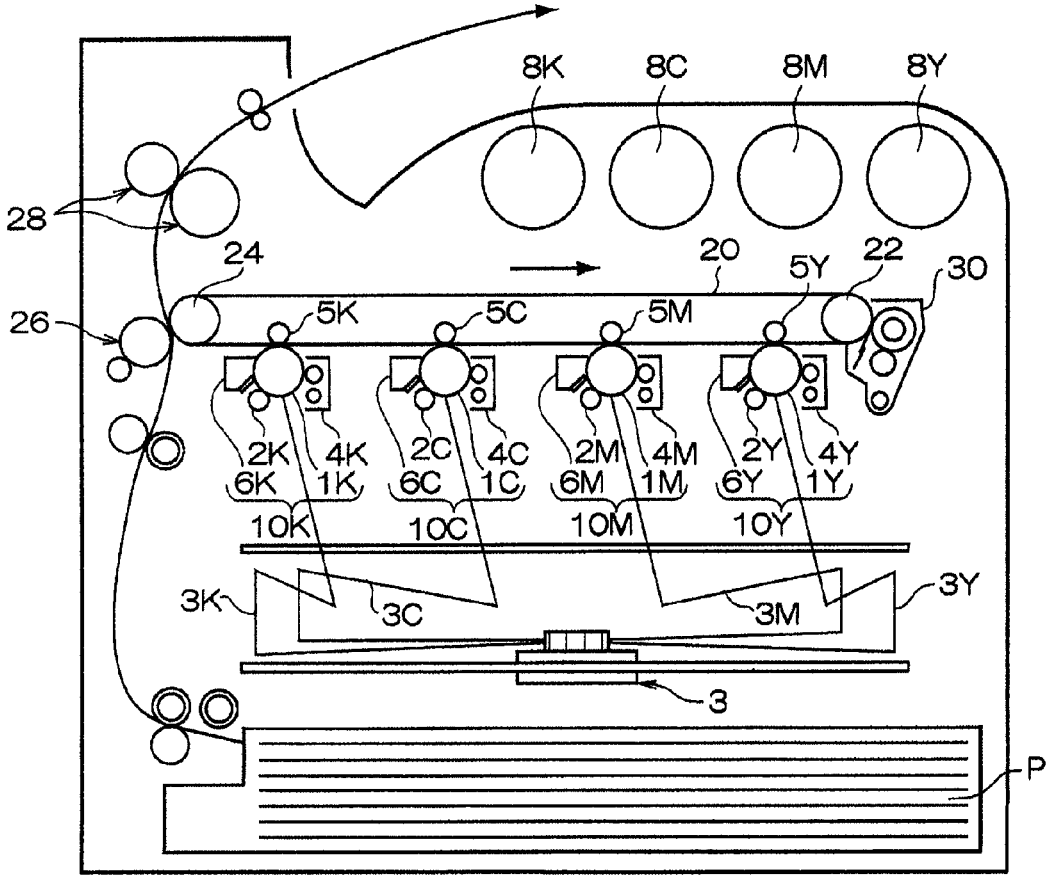
FIG. 2 is a schematic configurational diagram showing an example of an image forming device of the invention.

FIG. 2 is a schematic configurational diagram showing a 4-drum tandem full-color image forming device. The image forming device shown in FIG. 2 includes first to fourth electrophotographic image forming units 10Y, 10M, 10C and 10K (image forming units) that output images of the respective colors of yellow (Y), magenta (M), cyan (C) and black (K) based on color separation image data. Image forming units (hereinafter, simply referred to as "unit") 10Y, 10M, 10C and 10K are disposed in a horizontal direction at a distance from each other. Units 10Y, 10M, 10C and 10K each may be a process cartridge that can be detachably mounted on the image forming device body.

Upward of each of units 10Y, 10M, 10C and 10K in the drawing, intermediate transfer belt 20, which is an intermediate transfer body, is extended through the respective units. Intermediate transfer belt 20 is disposed wound around driving roller 22 and support roller 24, which are in contact with an inner surface of the intermediate transfer belt 20, the driving roller 22 and support roller 24 being disposed at positions separated from each other in a horizontal direction in the drawing, and runs in a direction from first unit 10Y to fourth unit 10K. Support roller 24 is biased by a spring or the like (not shown) in a direction departing from driving roller 22, whereby tension is applied to intermediate transfer belt 20 as wound around both rollers. Furthermore, intermediate transfer body cleaning device 30 is disposed facing drive rollers 22 on the image carrier surface side of the of intermediate transfer belt 20.

Furthermore, the toners of the respective colors of yellow, magenta, cyan and black contained in toner cartridges 8Y, 8M, 8C and 8K are fed to respective developing devices (developing units) 4Y, 4M, 4C and 4K of respective units 10Y, 10M, 10C and 10K.

First to fourth units 10Y, 10M, 10C and 10K have substantially the same configuration. Accordingly, herein, first unit 10Y that is disposed on an upstream side in a running direction of the intermediate transfer belt and forms a yellow image is taken as a representative and will be described. To portions identical with first unit 10Y, in place of yellow (Y), the reference numeral may be provided with magenta (M), cyan (C) or black (K) and, therefore, descriptions of units 10M, 10C and 10K will be omitted.

First unit 10Y has photoreceptor 1Y that works as an image carrier. Around photoreceptor 1Y, charging roller 2Y that charges a surface of the photoreceptor 1Y, exposure device 3 by which a charged surface is exposed with laser beam 3Y in accordance with a color separation image signal to form an electrostatic latent image, developing device (developing unit) 4Y that develops an electrostatic latent image by feeding charged toner to the electrostatic latent image, first transfer roller 5Y (first transfer unit) that transfers a developed toner image onto intermediate transfer belt 20, and photoreceptor cleaning device (cleaning unit) 6Y that removes the toner remaining on a surface of photoreceptor 1Y after the first transfer, are disposed in order.

First transfer roller 5Y is disposed inside of intermediate transfer belt 20 and at a position facing photoreceptor 1Y. Furthermore, a bias power source (not shown) that applies a first transfer bias is connected to each of first transfer rollers 5Y, 5M, 5C and 5K. In each of the bias power sources, a transfer bias applied to each of the first transfer rollers is varied by controlling by use of a controller (not shown).

In what follows, an operation of first unit 10Y when a yellow image is formed will be described. First, in advance of the operation, a surface of photoreceptor 1Y is charged to a potential from about −600 V to about −800 V using charging roller 2Y.

Photoreceptor 1Y is formed of an electroconductive base material (e.g., having a volume resistivity at 20° C. of $1\times10^{-6}$ Ωcm or less) and a photosensitive layer disposed on the base material. The photosensitive layer has usually a high resistance (e.g., a resistance substantially the same as that of general resins), but, upon irradiation with laser ray 3Y, the specific resistance of the portion irradiated with the laser ray changes. According to image data for yellow color sent from a controller (not shown), laser ray 3Y is outputted via exposure device 3 onto the surface of charged photoreceptor 1Y. The photosensitive layer on the surface of photoreceptor 1Y is irradiated with laser ray 3Y, whereby an electrostatic image is formed in a yellow print pattern on the surface of photoreceptor 1Y.

The electrostatic latent image is an image that is formed on the surface of photoreceptor 1Y by charging. Specifically, the electrostatic latent image is a so-called negative latent image that is formed as follows: the resistivity of an irradiated portion of the photosensitive layer is decreased by laser beam 3Y, whereby a charge on the surface of photoreceptor 1Y flows, while a charge of a portion that is not irradiated with laser beam 3Y remains.

The electrostatic latent image formed on photoreceptor 1Y in this manner is rotated to a development position as photoreceptor 1Y travels. Then, at the development position, the electrostatic latent image on photoreceptor 1Y is visualized (developed image) by developing device 4Y.

Developing device 4Y houses, for example, a yellow toner that contains at least a yellow colorant, a crystalline resin, and an amorphous resin and has a volume-average particle diameter of 7 μm. The yellow toner is stirred inside of developing device 4Y and thereby frictionally charged, and is held on a developer roller (developer carrier) with a charge having the same polarity (negative polarity) as the charge on photoreceptor 1Y. Then, when the surface of photoreceptor 1Y passes through developing device 4Y, the yellow toner is electrostatically attached to a neutralized latent image portion on the surface of photoreceptor 1Y, and the latent image is developed by the yellow toner. Photoreceptor 1Y, on which the yellow toner image is formed, travels continuously, and then the toner image developed on photoreceptor 1Y is transported to a first transfer position.

When the yellow toner image on photoreceptor 1Y is transported to the first transfer position, a first transfer bias is applied to first transfer roller 5Y, whereby an electrostatic force from photoreceptor 1Y toward first transfer roller 5Y acts on the toner image, and thereby the toner image on photoreceptor 1Y is transferred on intermediate transfer belt 20. A transfer bias applied at this time has a positive (+) polarity opposite to the polarity (−) of the toner and is controlled by a controller (not shown) to substantially +10 μA in first unit 10Y, for example.

Meanwhile, the toner that remains on photoreceptor 1Y is removed by cleaning device 6Y and collected.

The first transfer bias that is applied to each of first transfer rollers 5M, 5C, and 5K after second unit 10M is controlled in the manner same as in the first unit.

In this manner, intermediate transfer belt 20, on which the yellow toner image is transferred at first unit 10Y, is sequentially conveyed from second to fourth units 10M, 10C, and 10K, whereby toner images of the respective colors are superposed and transferred while being superimposed.

Intermediate transfer belt 20, on which the toner images of the four colors are transferred while being superimposed through the first to fourth units, reaches a second transfer portion that is sandwiched between support roller 24 in contact with an inner surface of intermediate transfer belt 20 and a second transfer roller (second transfer unit) disposed on an image holding surface side of intermediate transfer belt 20. Meanwhile, recording paper (image receiving member) P is supplied through a paper feed mechanism to the gap where second transfer roller 26 and intermediate transfer belt 20 are pressure-contacted, and a second transfer bias is applied to support roller 24. A transfer bias applied at this time has a negative (−) polarity identical to the polarity (−) of the toner. An electrostatic force from intermediate transfer belt 20 toward recording paper P acts on the toner image, and the toner image on intermediate transfer belt 20 is transferred to recording paper P. At this time, the second transfer bias is determined depending on resistance detected by a resistance detection unit (not shown) that detects the resistance of the second transfer portion, and is voltage-controlled.

Subsequently, recording paper P is forwarded to fixing device (fixing unit) 28, the toner image is heated, and the color-superposed toner image is melted and fixed on recording paper P. Recording paper P, on which a color image has been fixed, is sent toward an ejection port, whereby a series of the color image forming operation comes to completion.

Moreover, in the above-exemplified image forming device, the toner image is transferred through intermediate transfer belt 20 onto recording paper P. However, the invention is not restricted thereto. For example, the toner image may be directly transferred from the photoreceptor onto the recording paper.

Process Cartridge and Toner Cartridge

Figure 3:
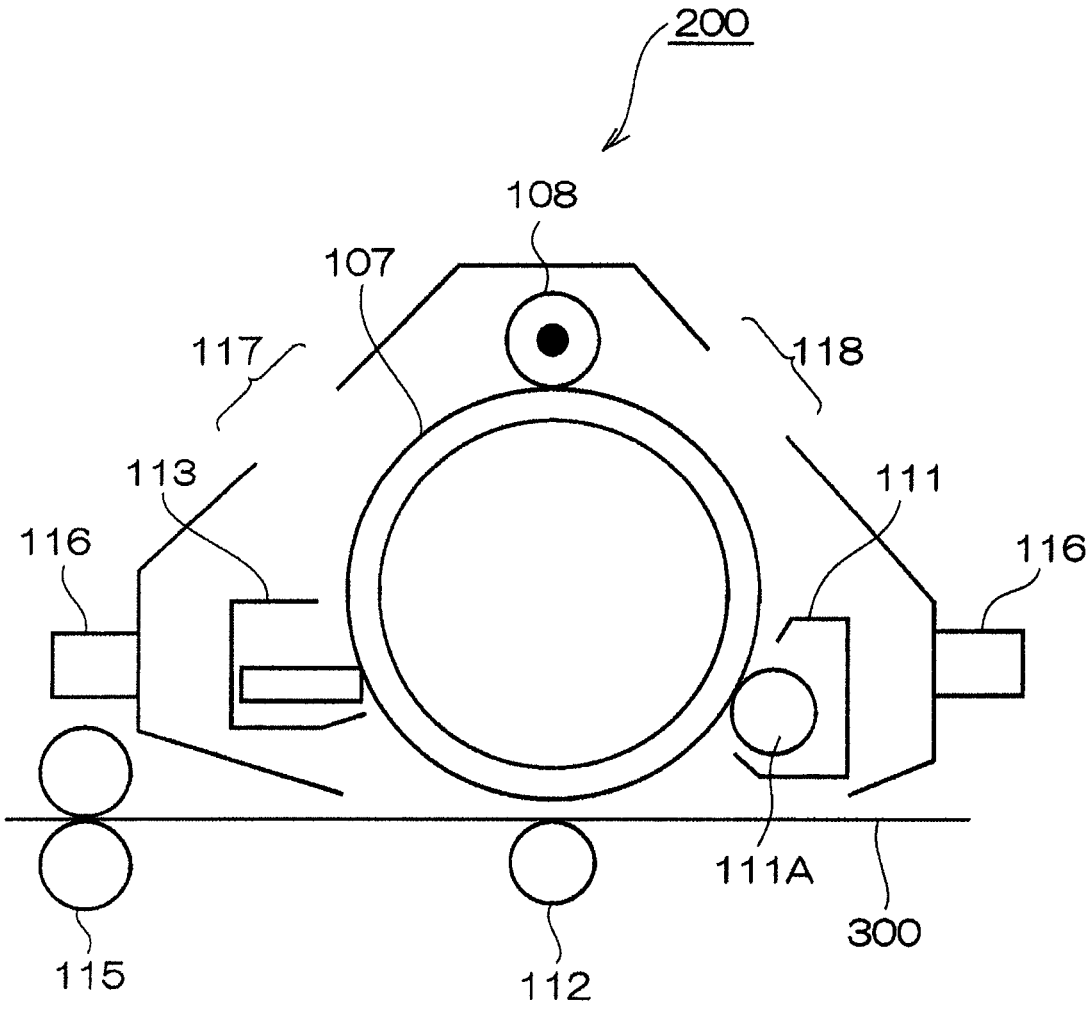
FIG. 3 is a schematic configurational diagram showing an example of a process cartridge of the invention.

FIG. 3 is a schematic configurational diagram showing an example of a process cartridge that houses an electrostatic charge image developer according to an exemplary embodiment of the invention. Process cartridge 200 includes photoreceptor 107, charging roller 108, developing device 111 provided with developer carrier 111A, and photoreceptor cleaning device (cleaning unit) 113, which are assembled and integrated by mounting rail 116, and has opening 118 for exposure and opening 117 for neutralization exposure.

Process cartridge 200 is detachably mounted on the main body of the image forming device including transfer device 112, fixing device 115, and other constituents (not shown). Process cartridge 200 constitutes, together with the main body of the image forming apparatus, an image forming device that forms an image on recording paper 300.

The process cartridge shown in FIG. 3 includes charging device 108, developing device 111, cleaning device (cleaning unit) 113, opening 118 for exposure, and opening 117 for neutralization exposure. However, these constituents may be selectively combined. The process cartridge of the exemplary embodiment includes at least developing device 111 provided with developer carrier 111A, and may include at least one selected from a group consisting of photoreceptor 107, charging device 108, cleaning device (cleaning unit) 113, opening 118 for exposure, and opening 117 for neutralization exposure.

Next, a toner cartridge of the exemplary embodiment will be described. The toner cartridge is mounted detachably on the image forming device and contains the toner of the exemplary embodiment in the toner cartridge that contains the toner for feeding to the developing unit disposed in the image forming device image forming device. Moreover, the toner cartridge of the exemplary embodiment may contain at least a toner, or may contain a developer depending on the configuration of the image forming device.

Accordingly, in an image forming device having a configuration where the toner cartridge is detachably mounted, when the toner cartridge that contains the toner of the exemplary embodiment is utilized, the toner of the exemplary embodiment is readily fed to the developing device.

The image forming device shown in FIG. 2 is an image forming device that has the configuration where toner cartridges 8Y, 8M, 8C, and 8K are detachable mounted, and developing devices 4Y, 4M, 4C, and 4K are connected to toner cartridges corresponding to the respective developing devices (colors) via not shown toner feed pipes. Furthermore, when the toner contained in the toner cartridge is used up, the toner cartridge may be replaced.

Image Forming Method

An image forming method in which the toner of the exemplary embodiment is used will be described. The toner of the exemplary embodiment may be utilized in an image forming method that makes use of a known electrophotographic method. Specifically, the toner of the exemplary embodiment is utilized in an image forming method that has following processes.

That is, a image forming method includes: a charging process in which a surface of an electrostatic charge image carrier is uniformly charged; a latent image forming process in which a latent image is formed on a surface of the charged electrostatic charge image carrier; a developing process in which a toner image is formed by developing the latent image formed on a surface of the electrostatic charge image carrier using a developer containing at least toner; a transfer process in which the toner image formed on the surface of the electrostatic charge image carrier is transferred onto a transfer receiving body; a fixing step in which the toner image transferred onto the transfer receiving body is fixed; and a cleaning process in which the toner remaining on a surface of the electrostatic charge image carrier after transfer is removed, in which the toner of the exemplary embodiment is used as the toner. Furthermore, in the transfer process, an intermediate transfer body that mediates transfer of a toner image from the electrostatic charge image carrier to the transfer receiving body may be used.

EXAMPLES

In what follows, the present invention will be described in more detail by referring to examples and comparative examples. However, the invention is not restricted thereto. Hereinafter, unless otherwise noted, "parts" indicates "parts by weight", and "%" indicates "% by weight".

Measurement Methods

Methods of Measuring Volume Average Particle Diameter and Particle Size Distribution of Toner and Others A volume average particle diameter and a particle size distribution index are measured with COULTER MULTISIZER II (trade name, manufactured by Beckman-Coulter Corp.), wherein ISOTON-II (trade name, manufactured by Beckman-Coulter Corporation) is used as an electrolytic solution.

In the measurement, a surfactant, preferably sodium alkyl benzene sulfonate, is used as a dispersing agent. Into 2 ml of a 5% aqueous solution thereof, 0.5 to 50 mg of a measurement sample is added. The solution is added to 100 to 150 ml of the electrolytic solution.

The electrolytic solution in which the added measurement sample is suspended is subjected to a dispersion treatment for 1 min using an ultrasonic disperser, followed by measuring a particle size distribution of particles having diameters of from 0.6 to 18 μm using the COULTER MULTISIZER II with an aperture having an aperture diameter of 30 μm, and a particle diameter is obtained.

From the measured particle size distribution, a cumulative distribution is depicted for each of volume and number from a smaller particle size to divided particle size ranges (channels). Particle diameters at an accumulation of 16% are defined as D16v for volume and as D16p for number, and particle diameters at an accumulation of 50% are defined as D50v for volume and as D50p for number. Similarly, particle diameters at an accumulation of 84% are defined as D84v for volume and as D84p for number. Herein, the volume average particle diameter means D50v, the volume average particle size distribution index (GSDv) is represented by $(D84v/D16v)^{1/2}$, and the number average particle size distribution index (GSDp) is represented by $(D84p/D16p)^{1/2}$.

Method of Measuring Shape Factor SF1 of Toner

The shape factor SF1 of a toner is obtained in such a manner that an optical microscopic image of toner particles dispersed on a slide glass is taken by a video-camera and sent to a LUZEX image analyzer, maximum lengths of toner diameters and projected areas of toners of 50 or more toner particles are measured, and average values of 50 or more toner particles is obtained in accordance with the following Formula (2).

$$SF1=((\text{maximum length of toner diameter})^2/\text{projected area of toner})\times(\pi/4)\times 100 \quad \text{Formula (2):}$$

Method of Measuring Molecular Weight of Resin

The molecular weights of binder resins (crystalline polyester resin and amorphous polyester resin) are measured by gel permeation chromatography (GPC) using "HLC-8120GPC, SC-8020 UNIT" (trade name, manufactured by Tosoh Corporation), two "TSKge1, Super HM-H" (trade name, manufactured by Tosoh Corporation; having 6.0 mm ID×15 cm) as columns, and tetrahydrofuran (THF) as an eluent.

The measurement is conducted using an IR detector under conditions in which a sample concentration is 0.5%, a flow rate is 0.6 ml/min, a sample injection amount is 10 μl, and a measurement temperature is 40° C. Furthermore, a calibration curve is prepared using "polystyrene standard samples TSK, standard": ten samples of "A-500", "F-1", "F-10", "F-80", "F-380", "A-2500", "F-4", "F-40", "F-128", and "F-700" (trade name, manufactured by Tosho Corporation).

Measurement Methods of Glass Transition Temperature and Melting Temperature

The glass transition temperature and melting temperature are measured with a differential calorimeter (trade name: DSC3110, THERMAL ANALYSIS SYSTEM 001, manufactured by Mac-Science Corporation) according to ISO 3146 (1985). A melting temperature of a mixture of indium and zinc is used for correction of a temperature of a detector of the calorimeter, and a heat of fusion of indium is used for correction of a heat amount. A sample is put in an aluminum pan, the aluminum pan in which a sample has been put and an empty aluminum pan for reference use are set, and a measurement is conducted at a temperature-rise speed of 10° C./min.

A temperature of a summit of the maximum endothermic peak of endothermic peaks of a DSC curve obtained by the measurement is taken as the melting temperature.

Furthermore, a temperature at an intersection of a base line in an endothermic portion and an extended line of an ascending line of a DSC curve obtained by the measurement is taken as the glass transition temperature.

Method of Measuring Fusing Temperature

A fusing temperature of an amorphous polyester resin is measured in such a manner that a temperature-apparent viscosity curve is obtained using a flow tester (trade name: CFT-500F, manufactured by Shimadzu Corporation), and a temperature at which the melt viscosity is $1\times10^4$ Pa·s on the viscosity curve is taken as the fusing temperature.

Measurement Conditions of the Melt Viscosity are as Follows:

temperature-rise speed is 3.0° C./min, initial temperature is 80.0° C., achieving temperature is 150° C., measurement interval is 3.0 sec, preheating time is 300.0 sec, cylinder pressure is 10.0 kgf/cm$^2$ (0.98 MPa), die hole diameter is 1.0 mm, and die length is 1.0 mm.

Example 1

| | |
|---|---|
| Binder resin 1 (amorphous polyester resin) prepared from bisphenol A-propylene oxide adduct (having an average addition mol number of 2)/bisphenol A-ethylene oxide adduct (having an average addition mol number of 2)/isophthalic acid/dimethyl terephthalate/dodecenyl succinate anhydride = 200/100/60/100/40, and having a weight average molecular weight of 19,000, a glass transition temperature (Tg) of 61.5° C., and a melting temperature (Tm) of 107° C. | 50 parts by weight |
| Binder resin 2 (amorphous polyester resin) prepared from bisphenol A-propylene oxide adduct (average addition mol number 2.2)/bisphenol A-ethylene oxide adduct (average addition mol number 2)/isophthalic acid/dimethyl terephthalate/dodecenyl succinate anhydride = 150/150/20/100/80, and having a weight average molecular weight of 78,000, a glass transition temperature of 56.2° C., and Tm of 118° C. | 50 parts by weight |
| Crystalline polyester resin 1 prepared from 1,10-dodecane dioic acid/1,9-nonanediol, having a weight average molecular weight of 24,500 and a melting temperature of 75° C. | 7 parts by weight |
| Releasing agent 1: paraffin wax (product name: FNP0090, having a melting temperature of 90.2° C., manufactured by Nippon Seiro Co., Ltd.) | 10 parts by weight |
| Colorant 1: copper phthalocyanine pigment B15:3 (trade name, manufactured by BASF) | 5 parts by weight |

The above components are blended using a 75-L Henschel mixer, followed by kneading using a continuous kneader (biaxial extruder) having a screw configuration shown in FIG. 1 under the following conditions. A rotation number of the screw is 500 rpm, and a feed amount is 50 kg/min.

Temperature of feeding portion (blocks 12A and 12B): 20° C.

Kneading temperature in a kneading portion 1 (from block 12C to 12E): 90° C.

Kneading temperature in a kneading portion 2 (from block 12F to 12J): 115° C.

Addition amount of an aqueous medium (distilled water): 1.5 parts by weight with respect to 100 parts by weight of the feed amount of a raw material At this time, a temperature of a kneaded material at an ejection port (ejection port 18) is 125° C.

The kneaded material is rapidly cooled using a mill roll inside of which brine cooled at −5° C. flows and a slab insertion cooling belt that is cooled to 2° C. by cool water, roughly pulverized using a pin mill, followed by pulverizing using a hammer mill. A rapid cooling speed is confirmed by changing a speed of a cooling belt, and an average temperature-decrease speed is found to be 10° C./sec.

Thereafter, a pulverizer (AFG 400, trade name, manufactured by Hosokawa Micron Group) housing a coarse particle classifier is used to pulverize the kneaded material, whereby a toner having a volume average particle diameter of 5.8 μm is obtained. During the pulverization, 0.7 parts by weight of silica (hexamethyl disilazane-treated silica having a volume average particle diameter of 40 nm) is added with respect to 100 parts by weight of the toner forming material, followed by classification using an inertia classifier to remove fine particles and coarse particles.

To the resultant toner particles, 1.5 parts by weight of a titanium compound obtained by treating 100 parts by weight of metatitanic acid with 40 parts by weight of isobutyltrimethoxysilane, and 1.2 parts by weight of hexamethylene disilazane-treated spherical silica having a particle diameter of 130 nm are added. The mixture is blended (external blending) using a 75-L Henschel mixer for 10 min, followed by sieving at 45 μm with a wind sifter (HIGH BOLTER), whereby toner 1-C is obtained.

Toner 1-Y, toner 1-K and toner 1-M, respectively, are prepared in the same manner as in the method of producing toner 1-C except that colorant 1 that is "copper phthalocyanine pigment B15: 3 (5 parts by weight)" is changed to "PY180 (6.5 parts by weight)", "carbon black R330 (6 parts by weight)" and "PR122 (4 part by weight) and PR283 (4 parts by weight)", respectively.

Comparative Example 1

Toner 2-Y, toner 2-M, toner 2-C and toner 2-K, respectively, are prepared in the same manner as in the methods of producing toner 1-Y, toner 1-M, toner 1-C and toner 1-K, except that crystalline polyester resin 1 that is "(1,10-dodecane dioic acid/1,9-nonanediol, having a weight average molecular weight of 24,500, and a melting temperature of 75° C.) 7 parts by weight" is changed to "(terephthalic acid/1,9-nonanediol, having a weight average molecular weight of 22,000, and a melting temperature of 94° C.) 7 parts by weight".

Comparative Example 2

Toner 3-Y, toner 3-M, toner 3-C and toner 3-K, respectively, are prepared in the same manner as in Example 1, except that releasing agent 1 that is "(paraffin wax, product name: FNP0090, having a melting temperature of 90.2° C., manufactured by Nippon Seiro Co., Ltd.) 10 parts by weight" is changed to "(polyethylene wax, product name: PW725, having a melting temperature of 104° C., manufactured by Toyo Petrolite Co., Ltd.) 10 parts by weight", and a kneading temperature in kneading portion 1 is changed from 90° C. to 105° C.

Comparative Example 3

Toner 4-Y, toner 4-M, toner 4-C and toner 4-K, respectively, are prepared in the same manner as that in Example 1, except that, in the composition of Example 1, "100 parts by weight" of "binder resin 3 (amorphous polyester resin) prepared from bisphenol A-propylene oxide adduct (having an average addition mol number of 2)/bisphenol A-ethylene oxide adduct (having an average addition mol number of 2)/isophthalic acid/dimethyl terephthalate=200/100/100/120, and having a weight average molecular weight of 25,000, a glass transition temperature of 64.5° C., and Tm of 112° C." is used instead of binder resins 1 and 2, kneading conditions are changed to the conditions described below, and cooling conditions are changed in such a manner that a brine temperature is changed to 17° C., a slab thickness is changed to 5 mm, a speed of the cooling belt is increased and a cooling water temperature is changed to 17° C.

Temperature of kneading portion 1: 115° C.

Temperature of kneading portion 2: 140° C.

Addition amount of an aqueous medium (distilled water): 0%

At this time, a temperature of a kneaded resin is 150° C., and a cooling speed is Δ1.5° C.

Example 2

| | |
|---|---|
| Binder resin 4 (amorphous polyester resin) prepared from bisphenol A-propylene oxide adduct (having an average addition mol number of 2.2)/bisphenol A-ethylene oxide adduct (having an average addition mol number of 2)/isophthalic acid/dimethyl terephthalate = 150/160/120/100, and having a weight average molecular weight of 48,000, Tg of 58.3° C., and Tm of 112° C. | 90 parts by weight |
| Crystalline polyester resin prepared from 1,10-dodecane dioic acid/1,6-hexanediol, having a melting temperature of 75° C. | 14 parts by weight |
| Releasing agent 2: ester wax (product name: WEP5, having a melting temperature of 84.5° C., manufactured by Chukyo Yushi Co., Ltd.) | 12 parts by weight |
| Releasing agent 3: polyethylene wax (product name: PW725, having a melting temperature of 104° C., manufactured by Toyo Petrolite Co., Ltd.) | 2 parts by weight |
| Colorant 1: the same colorant as that used in Example 1. | |

Toner 5-Y, toner 5-M, toner 5-C and toner 5-K, respectively, are prepared in the same manner as that in Example 1, except that the above-mentioned materials are used and kneading conditions are changed to those shown in Table 1.

Example 3

Toner 6-Y, toner 6-M, toner 6-C and toner 6-K, respectively, are prepared in the same manner as that in Example 1 except that silica is not added during the pulverization in Example 1.

Example 4

Toner 7-Y, toner 7-M, toner 7-C and toner 7-K, respectively, are prepared in the same manner as that in Example 1 except that the kneading conditions are changed to conditions shown in Table 2, the rotation number of the screw is reduced to 0.74 times that of Example 1, and the feed amount is reduced to one half that of Example 1. An ejection temperature of the kneaded material at this time is 138° C.

Example 5

Toner 8-Y, toner 8-M, toner 8-C and toner 8-K, respectively, are prepared in the same manner as that in Example 1 except that the addition amount of distilled water is changed to 4 parts by weight, and the cooling conditions are changed to those used in Comparative Example 3.

Example 6

Toner 9-Y, toner 9-M, toner 9-C and toner 9-K, respectively, are prepared in the same manner as that in Example 2 except that the kneading conditions are changed to conditions shown in Table 2, the addition amount of distilled water is changed to 2.5 parts by weight, and silica is not added at the pulverization similarly to Example 3.

Example 7

Toner 10-Y, toner 10-M, toner 10-C and toner 10-K, respectively, are prepared in the same manner as in Example 1 except that the addition of distilled water during kneading, the rapid cooling after kneading and the addition of an inorganic oxide (silica) during pulverization are not performed.

Example 8

Toner 11-Y, toner 11-M, toner 11-C and toner 11-K, respectively, are prepared in the same manner as that in Example 1 except that the amount of the releasing agent is changed from 10 parts by weight to 19 parts by weight.

Example 9

Toner 12-Y, toner 12-M, toner 12-C and toner 12-K, respectively, are prepared in the same manner as that in Example 1, except that binder resin 1 is changed to "50 parts by weight" of "amorphous polyester resin prepared from bisphenol A-propylene oxide adduct (having an average addition mol number of 2)/bisphenol A-ethylene oxide adduct (having an average addition mol number of 2)/isophthalic acid/dimethyl terephthalate/octenyl succinate anhydride=250/50/50/50/100, and having a weight average molecular weight of 18,000, a glass transition temperature of 58.5° C., and a melting temperature (Tm) of 105"C", and binder resin 2 is changed to "50 parts by weight" of "amorphous polyester resin prepared from bisphenol A-propylene oxide adduct (having an average addition mol number of 2.2)/bisphenol A-ethylene oxide adduct (having an average addition mol number of 2)/dimethyl terephthalate/octenyl succinate anhydride=150/150/50/150, and having a weight average molecular weight of 98,000, a glass transition temperature of 55.1° C., Tm of 116"C".

Preparation of Developer

Preparation of Carrier 100 parts by weight of ferrite core having a particle diameter of 35 μm is coated with a mixed solution obtained by dissolving and mixing 2.0 parts by weight of a methyl methacrylate resin, 0.6 parts by weight of carbon black (VXC72, trade name, manufactured by Cabot Corporation) and 0.3 parts by weight of melamine beads (EPOSTAR S, trade name, manufactured by Nippon Shokubai Co., Ltd.) in 10 parts by weight of toluene using a kneader device, whereby a carrier is prepared. A developer is obtained by mixing 92 parts by weight of the resultant carrier and 8 parts by weight of one of the toners using a V-blender.

Evaluation of Toner and Developer

The resultant two-component developer is subjected to a fixing test using a process speed-variable modified DOCUCENTRE-IIC7500 (trade name, manufactured by Fuji Xerox Co., Ltd.) with a fixing temperature changing from 120 to 250° C. under a process speed fixed at 350 mm/sec.

Furthermore, the resultant developer is subjected to image quality maintenance test of each of 10000 sheets and 100000 sheets by use of the modified machine, with a fixing temperature fixed at the lowest fixing temperature of the developer +20° C. and a process speed fixed at 350 mm/sec, and alternately under an environment where a temperature is 30° C. and humidity is 90% and under an environment where a temperature is 10° C. and humidity is 30%.

Moreover, the resultant toner is left under an environment where a temperature is 50° C. and humidity is 50% for 24 hr, followed by further leaving under an environment where a temperature is 55° C. and humidity is 50% for 60 hr. Thereafter, a developer is prepared using the toner, and subjected to an initial image quality test of 1,000 sheets using the modified machine with the fixing temperature fixed at the lowest fixing temperature +20° C. and the process speed fixed at 350 mm/sec.

Furthermore, 100 g of the toner that has been left under the above environments is sieved manually using a mesh having openings of 106 μm, and a blocking state thereof is observed.

Still furthermore, the resultant toners that have not been left under the above environments are subjected to measurement of a volume average particle diameter, a shape factor SF1, a temperature at which an endothermic peak is generated in the temperature-rise process of differential scanning calorimetry and an amount of a releasing agent present at a toner surface (which is calculated from a CC/CO ratio in an XPS measurement) according to the methods mentioned above, and results are shown in Tables 1 and 2.

In Tables 1 and 2, "first" DSC peak indicates a temperature at which an endothermic peak derived from the compatibility of a crystalline polyester resin and an amorphous polyester resin is generated, "second" DSC peak indicates a temperature at which an endothermic peak derived from a crystalline polyester resin is generated, and "third" DSC peak indicates a temperature at which an endothermic peak derived from a releasing agent is generated.

TABLE 1

| | | Amount of alkenyl succinate component in amorphous resin | Amount of releasing agent in toner | Particle diameter | Shape factor | Kneading condition: Temperature in kneading 1 | Kneading condition: Temperature in kneading 2 | Kneading condition: Amount of water (parts by weight) | Kneading condition: Cooling speed at milling (° C./sec) | DSC peaks: First | DSC peaks: Second | DSC peaks: Third | Existence ratio of surface releasing agent |
|---|---|---|---|---|---|---|---|---|---|---|---|---|---|
| | Color | (wt %) | (wt %) | (μm) | SF1 | 1 (° C.) | 2 (° C.) | | | First | Second | Third | (wt %) |
| Example 1 | Y | 12 | 8.1 | 5.8 | 147 | 90° C. | 115° C. | 1.5 | ⊿10 | 55° C. | 69° C. | 90° C. | 13 |
| | M | 12 | 8 | 5.8 | 148 | 90° C. | 115° C. | 1.5 | ⊿10 | 56° C. | 68° C. | 90° C. | 15 |
| | C | 12 | 8.2 | 5.9 | 146 | 90° C. | 115° C. | 1.5 | ⊿10 | 55° C. | 69° C. | 90° C. | 12 |
| | K | 12 | 8.1 | 6 | 145 | 90° C. | 115° C. | 1.5 | ⊿10 | 56° C. | 68° C. | 90° C. | 16 |
| Comparative example 1 | Y | 12 | 8.1 | 5.7 | 152 | 90° C. | 115° C. | 1.5 | ⊿10 | 60° C. | 90° C. | — | 37 |
| | M | 12 | 8 | 5.9 | 151 | 90° C. | 115° C. | 1.5 | ⊿10 | 60° C. | 90° C. | — | 35 |
| | C | 12 | 8.2 | 5.8 | 151 | 90° C. | 115° C. | 1.5 | ⊿10 | 60° C. | 90° C. | — | 36 |
| | K | 12 | 8.1 | 5.9 | 150 | 90° C. | 115° C. | 1.5 | ⊿10 | 60° C. | 90° C. | — | 38 |
| Comparative example 2 | Y | 12 | 8.1 | 6 | 149 | 105° C. | 115° C. | 1.5 | ⊿10 | 55° C. | 69° C. | 105° C. | 31 |
| | M | 12 | 8 | 6.1 | 150 | 105° C. | 115° C. | 1.5 | ⊿10 | 55° C. | 69° C. | 105° C. | 33 |
| | C | 12 | 8.2 | 6.2 | 149 | 105° C. | 115° C. | 1.5 | ⊿10 | 55° C. | 69° C. | 105° C. | 31 |
| | K | 12 | 8.1 | 6 | 152 | 105° C. | 115° C. | 1.5 | ⊿10 | 55° C. | 69° C. | 105° C. | 33 |
| Comparative example 3 | Y | 0 | 8.1 | 5.7 | 146 | 115° C. | 140° C. | 0 | ⊿1.5 | 64° C. | 69° C. | 90° C. | 50 |
| | M | 0 | 8 | 5.8 | 147 | 115° C. | 140° C. | 0 | ⊿1.5 | 63° C. | 68° C. | 90° C. | 55 |
| | C | 0 | 8.2 | 5.8 | 150 | 115° C. | 140° C. | 0 | ⊿1.5 | 64° C. | 69° C. | 90° C. | 52 |
| | K | 0 | 8.1 | 5.7 | 150 | 115° C. | 140° C. | 0 | ⊿1.5 | 63° C. | 68° C. | 90° C. | 48 |
| Example 2 | Y | 0 | 11.2 | 6.6 | 144 | 85° C. | 115° C. | 1.5 | ⊿10 | 59° C. | 72° C. | 85° C. | 28 |
| | M | 0 | 11.1 | 6.5 | 143 | 85° C. | 115° C. | 1.5 | ⊿10 | 59° C. | 72° C. | 85° C. | 23 |
| | C | 0 | 11.4 | 6.5 | 146 | 85° C. | 115° C. | 1.5 | ⊿10 | 59° C. | 72° C. | 85° C. | 25 |
| | K | 0 | 11.3 | 6.2 | 145 | 85° C. | 115° C. | 1.5 | ⊿10 | 59° C. | 72° C. | 85° C. | 29 |
| Example 3 | Y | 12 | 8.1 | 5.8 | 147 | 90° C. | 115° C. | 1.5 | ⊿10 | 55° C. | 69° C. | 90° C. | 15 |
| | M | 12 | 8 | 5.8 | 148 | 90° C. | 115° C. | 1.5 | ⊿10 | 56° C. | 68° C. | 90° C. | 18 |
| | C | 12 | 8.2 | 5.9 | 146 | 90° C. | 115° C. | 1.5 | ⊿10 | 55° C. | 69° C. | 90° C. | 14 |
| | K | 12 | 8.1 | 6 | 145 | 90° C. | 115° C. | 1.5 | ⊿10 | 56° C. | 68° C. | 90° C. | 18 |

TABLE 2

| | | Amount of alkenyl succinate component in amorphous resin | Amount of releasing agent in toner | Particle diameter | Shape factor | Kneading condition: Temperature in kneading 1 | Kneading condition: Temperature in kneading 2 | Kneading condition: Amount of water (parts by weight) | Kneading condition: Cooling speed at milling (° C./sec) | DSC peaks: First | DSC peaks: Second | DSC peaks: Third | Existence ratio of surface releasing agent |
|---|---|---|---|---|---|---|---|---|---|---|---|---|---|
| | Color | (wt %) | (wt %) | (μm) | SF1 | 1 (° C.) | 2 (° C.) | | | First | Second | Third | (wt %) |
| Example 4 | Y | 12 | 8.1 | 5.7 | 146 | 85° C. | 100° C. | 0 | ⊿10 | 54° C. | 69° C. | 90° C. | 27 |
| | M | 12 | 8 | 5.7 | 149 | 85° C. | 100° C. | 0 | ⊿10 | 55° C. | 69° C. | 90° C. | 29 |

TABLE 2-continued

| | Color | Amount of alkenyl succinate component in amorphous resin (wt %) | Amount of releasing agent in toner (wt %) | Particle diameter (μm) | Shape factor SF1 | Kneading condition: Temperature in kneading 1 (° C.) | Kneading condition: Temperature in kneading 2 (° C.) | Kneading condition: Amount of water (parts by weight) | Kneading condition: Cooling speed at milling (° C./sec) | DSC peaks: First | DSC peaks: Second | DSC peaks: Third | Existence ratio of surface releasing agent (wt %) |
|---|---|---|---|---|---|---|---|---|---|---|---|---|---|
| | C | 12 | 8.2 | 5.6 | 148 | 85° C. | 100° C. | 0 | ⊿10 | 56° C. | 69° C. | 90° C. | 27 |
| | K | 12 | 8.1 | 5.5 | 148 | 85° C. | 100° C. | 0 | ⊿10 | 57° C. | 67° C. | 90° C. | 28 |
| Example 5 | Y | 12 | 8.1 | 5.7 | 150 | 90° C. | 115° C. | 4 | ⊿1.5 | 54° C. | 69° C. | 90° C. | 23 |
| | M | 12 | 8 | 5.7 | 152 | 90° C. | 115° C. | 4 | ⊿1.5 | 55° C. | 68° C. | 90° C. | 26 |
| | C | 12 | 8.2 | 5.8 | 153 | 90° C. | 115° C. | 4 | ⊿1.5 | 55° C. | 68° C. | 90° C. | 25 |
| | K | 12 | 8.1 | 5.9 | 152 | 90° C. | 115° C. | 4 | ⊿1.5 | 56° C. | 67° C. | 90° C. | 26 |
| Example 6 | Y | 0 | 11.2 | 6 | 146 | 100° C. | 100° C. | 2.5 | ⊿10 | 57° C. | 72° C. | 85° C. | 32 |
| | M | 0 | 11.1 | 5.9 | 149 | 100° C. | 100° C. | 2.5 | ⊿10 | 58° C. | 72° C. | 85° C. | 29 |
| | C | 0 | 11.4 | 6.2 | 148 | 100° C. | 100° C. | 2.5 | ⊿10 | 58° C. | 72° C. | 85° C. | 33 |
| | K | 0 | 11.3 | 6 | 148 | 100° C. | 100° C. | 2.5 | ⊿10 | 57° C. | 72° C. | 85° C. | 31 |
| Example 7 | Y | 12 | 8.1 | 7.5 | 153 | 90° C. | 115° C. | 0 | ⊿1.5 | 55° C. | 69° C. | 90° C. | 32 |
| | M | 12 | 8 | 7.8 | 151 | 90° C. | 115° C. | 0 | ⊿1.5 | 56° C. | 68° C. | 90° C. | 35 |
| | C | 12 | 8.2 | 7.7 | 152 | 90° C. | 115° C. | 0 | ⊿1.5 | 55° C. | 69° C. | 90° C. | 33 |
| | K | 12 | 8.1 | 7.6 | 152 | 90° C. | 115° C. | 0 | ⊿1.5 | 56° C. | 68° C. | 90° C. | 35 |
| Example 8 | Y | 12 | 14.3 | 5.8 | 144 | 90° C. | 115° C. | 0 | ⊿10 | 55° C. | 69° C. | 90° C. | 28 |
| | M | 12 | 14.2 | 5.7 | 146 | 90° C. | 115° C. | 0 | ⊿10 | 56° C. | 68° C. | 90° C. | 30 |
| | C | 12 | 14.5 | 5.8 | 145 | 90° C. | 115° C. | 0 | ⊿10 | 55° C. | 69° C. | 90° C. | 28 |
| | K | 12 | 14.4 | 5.8 | 146 | 90° C. | 115° C. | 0 | ⊿10 | 56° C. | 68° C. | 90° C. | 31 |
| Example 9 | Y | 27.5 | 8.1 | 6 | 147 | 90° C. | 115° C. | 0 | ⊿10 | 50° C. | 69° C. | 90° C. | 12 |
| | M | 27.5 | 8 | 5.9 | 145 | 90° C. | 115° C. | 0 | ⊿10 | 51° C. | 68° C. | 90° C. | 16 |
| | C | 27.5 | 8.2 | 5.8 | 146 | 90° C. | 115° C. | 0 | ⊿10 | 51° C. | 69° C. | 90° C. | 14 |
| | K | 27.5 | 8.1 | 5.9 | 147 | 90° C. | 115° C. | 0 | ⊿10 | 52° C. | 68° C. | 90° C. | 15 |

Evaluation

Evaluation of Fixability

The fixability is evaluated based on the following criteria by measuring the lowest fixing temperature (lowest fixing temperature) and the highest fixing temperature, at which the offset does not occur when the fixing temperature is changed.

Evaluation Criteria of Fixing Characteristics (at Low Temperatures)

A: The lowest fixing temperature is less than 120° C.

B: The lowest fixing temperature is 120° C. or more and less than 130° C.

C: The lowest fixing temperature is 130° C. or more and less than 140° C.

D: The lowest fixing temperature is 140° C. or more and less than 150° C.

E: The lowest fixing temperature is 150° C. or more.

Evaluation Criteria of Fixing Characteristics (at High Temperatures)

A: The fixing temperature at which offset occurs is 230° C. or more.

B: The temperature at which offset occurs is 220° C. or more and less than 230° C.

C: The fixing temperature at which offset occurs is 210° C. or more and less than 220° C.

D: The fixing temperature at which offset occurs is 200° C. or more and less than 210° C.

E: The maximum fixing temperature is less than 200° C.

Evaluation of Storability (Hand Sieve Test)

100 g of the toner which has been stored under the respective environments is sieved using a standard mesh having openings of 106 μm, and the toner particle left on the sieve are weighed, and the storability of the toner is evaluated based on the following criteria.

Evaluation Criteria of Storability (Hand Sieve Test)

A: The amount of the remaining toner is less than 0.1 g.

B: The amount of the remaining toner is 0.1 g or more and less than 0.5 g.

C: The amount of the remaining toner is 0.5 g or more and less than 1.0 g.

D: The amount of the remaining toner is 1.0 g or more and less than 2.0 g.

E: The amount of the remaining toner is 2.0 g or more.

Evaluation results of the fixability and storability (hand sieve test) of the toners are shown in Table 3.

TABLE 3

| | Color | Fixing properties: At low temperatures | Fixing properties: At high temperatures | Storabilit Sieve |
|---|---|---|---|---|
| Example 1 | Y | A | B | A |
| | M | A | B | A |
| | C | A | B | A |
| | K | A | A | A |
| Comparative example 1 | Y | E | B | D |
| | M | E | B | C |
| | C | E | B | C |
| | K | E | B | D |
| Comparative example 2 | Y | D | B | C |
| | M | D | B | C |
| | C | D | B | C |
| | K | D | B | D |
| Comparative example 3 | Y | D | B | E |
| | M | E | B | E |
| | C | E | B | E |
| | K | E | B | D |

TABLE 3-continued

| | Color | Fixing properties At low temperatures | At high temperatures | Storabilit Sieve |
|---|---|---|---|---|
| Example 2 | Y | B | A | B |
| | M | B | A | B |
| | C | B | A | B |
| | K | B | A | A |
| Example 3 | Y | A | B | A |
| | M | A | B | B |
| | C | A | B | A |
| | K | A | B | B |
| Example 4 | Y | B | A | C |
| | M | B | A | C |
| | C | B | A | C |
| | K | B | A | C |
| Example 5 | Y | A | A | B |
| | M | A | A | B |
| | C | A | A | B |
| | K | A | A | B |
| Example 6 | Y | B | A | C |
| | M | B | A | B |
| | C | B | A | B |
| | K | B | A | C |
| Example 7 | Y | B | A | C |
| | M | B | B | B |
| | C | B | A | C |
| | K | B | B | C |
| Example 8 | Y | B | A | B |
| | M | B | A | C |
| | C | B | A | B |
| | K | B | A | B |
| Example 9 | Y | A | B | C |
| | M | A | B | B |
| | C | A | B | B |
| | K | A | B | B |

As shown in Table 3, it is found that the toners and developers of Examples of the invention have superior fixing characteristics and superior powder characteristics (storability) over those of Comparative Examples.

What is claimed is:

1. A toner for developing an electrostatic charge image, comprising:

an amorphous polyester resin;

a crystalline polyester resin; and a releasing agent, an amount of the releasing agent in the toner being from about 5 to about 15% by weight;

an amount of the releasing agent present at a surface of the toner being from about 10 to about 35% by weight; and the toner showing at least one endothermic peak in each of a temperature range from about 45 to about 60° C., a temperature range from about 65 to 80° C. being derived from the crystalline polyester resin, and a temperature range from about 85 to about 100° C. in a temperature-rise process of differential scanning calorimetry of the toner, the toner having a shape factor SFI of from 138 to 155.

2. The toner for developing an electrostatic charge image of claim 1, wherein the amorphous polyester resin comprises at least a polyvalent carboxylic acid component and a polyvalent alcohol component, and the polyvalent carboxylic acid component comprises an alkenyl succinate component.

3. The toner for developing an electrostatic charge image of claim 2, wherein an amount of the alkenyl succinate component in the amorphous polyester resin is from about 1 to about 35% by weight.

4. The toner for developing an electrostatic charge image of claim 1, wherein the amorphous polyester resin has a weight average molecular weight from about 15,000 to about 100,000.

5. The toner for developing an electrostatic charge image of claim 1, wherein an amount of the crystalline polyester resin in the toner is from about 1 to about 40% by weight.

6. The toner for developing an electrostatic charge image of claim 1, wherein the crystalline polyester resin has a weight average molecular weight of about 10,000 to about 30,000.

7. The toner for developing an electrostatic charge image of claim 1, wherein the toner has a shape factor of from 142 to 150.

8. A developer for electrostatic charge image development, comprising at least:

the toner for developing an electrostatic charge image of claim 1.

* * * * *